US006070958A

United States Patent [19]

Kanome

[11] Patent Number: 6,070,958

[45] Date of Patent: Jun. 6, 2000

[54] RECORDING APPARATUS AND METHOD OF CONTROLLING THE SAME

[75] Inventor: Yuji Kanome, Yokohama, Japan

[73] Assignee: Canon Kabushiki Kaisha, Tokyo, Japan

[21] Appl. No.: 09/098,423

[22] Filed: Jun. 17, 1998

[30] Foreign Application Priority Data

Jun. 19, 1997 [JP] Japan ..... 9-163030

[51] Int. Cl.[7] ..... B41J 2/195

[52] U.S. Cl. ..... 347/7; 347/19

[58] Field of Search ..... 347/7, 19, 85, 347/86

[56] References Cited

U.S. PATENT DOCUMENTS

| | | | |
|---|---|---|---|
| 4,313,124 | 1/1982 | Hara | 346/140 |
| 4,345,262 | 8/1982 | Shirato et al. | 346/140 |
| 4,459,600 | 7/1984 | Sato et al. | 346/140 |
| 4,463,359 | 7/1984 | Ayata et al. | 346/1.1 |
| 4,558,333 | 12/1985 | Sugitani et al. | 346/140 |
| 4,608,577 | 8/1986 | Hori | 346/140 |
| 4,723,129 | 2/1988 | Endo et al. | 346/1.1 |
| 4,740,796 | 4/1988 | Endo et al. | 346/1.1 |
| 5,414,452 | 5/1995 | Accatino et al. | 347/7 |
| 5,818,471 | 10/1998 | Shimamura et al. | 347/7 |
| 5,894,313 | 4/1999 | Mabuchi | 347/7 |
| 5,992,961 | 11/1999 | Ishikawa et al. | 347/7 |
| 5,997,120 | 12/1999 | Ohde et al. | 347/7 |

FOREIGN PATENT DOCUMENTS

| | | |
|---|---|---|
| 552472 | 7/1993 | European Pat. Off. . |
| 683052 | 11/1995 | European Pat. Off. . |
| 707969 | 4/1996 | European Pat. Off. . |
| 54-56847 | 5/1979 | Japan . |
| 59-123670 | 7/1984 | Japan . |
| 59-138461 | 8/1984 | Japan . |
| 60-71260 | 4/1985 | Japan . |
| 5-16384 | 1/1993 | Japan . |
| 9-156126 | 6/1997 | Japan . |

*Primary Examiner*—Fred L. Braun

*Attorney, Agent, or Firm*—Fitzpatrick, Cella, Harper & Scinto

[57] ABSTRACT

An recording apparatus and a method of controlling the operation of the recording apparatus in which the timing of replacing ink cartridges for supplying ink to a recording head or the timing of refilling the ink cartridges with ink is controlled in such a manner as to minimize the total amount of ink consumed during the operation of recovering the recording head performed after the ink cartridge is replaced or refilled thereby achieving a high efficiency in the replacement or refilling of ink cartridges. The amount of remaining ink is monitored for each ink cartridge. If an ink cartridge is detected to be so low in the amount of remaining ink that it should be replaced or refilled, then it is judged whether there is another ink cartridge whose amount of remaining ink is lower than a predetermined value. If there is such an ink cartridge, it is determined that the ink cartridge as well as the former one should also be replaced or refilled with ink. In accordance with the judgement result, information is presented about the ink cartridge which should be replaced or refilled. As opposed to conventional techniques in which there is a possibility that an ink cartridge runs out ink during a recovering operation performed after another ink cartridge was replaced or refilled with ink and thus it is also required to be replaced or refilled, the technique makes it possible to replace or refill ink cartridges in a highly efficient manner.

43 Claims, 17 Drawing Sheets

RECORDING APPARATUS AND METHOD OF CONTROLLING THE SAME

BACKGROUND OF THE INVENTION

1. Field of the Invention

The present invention relates to a recording apparatus for recording information on a recording medium by emitting an ink from a recording head and also to a method of controlling the operation of the recording apparatus.

More particularly, the present invention relates to a recording apparatus including a plurality of storage means for storing ink to be emitted by a recording head wherein each storage means can be replaced by a new one or can be refilled with ink independently of the other ones, and also to a method of controlling the operation of such a recording apparatus.

2. Description of the Related Art

In a serial type recording apparatus, a recording head serving as recording means mounted on a carriage moves across a recording medium (hereinafter also referred to as a recording sheet) in the main scanning direction substantially perpendicular to the direction (secondary scanning direction) in which the recording medium is moved thereby recording an image on the recording medium in the main direction. After completion of the recording along one line in the main scanning direction, the recording medium is moved by a fixed amount in the paper feeding direction. After that, an image is recorded on the recording medium at rest along the next line in the main scanning direction. The above operation is performed repeatedly until the image is formed over the entire recording area of the recording medium.

Among various types of recording apparatus, a recording apparatus of the ink-jet type, in which recording is accomplished by emitting ink from a recording head serving as recording means toward a recording medium, has the following advantages:

1. The recording means can be easily realized into a small form.

2. A high-resolution image can be recorded at a high speed.

3. Recording on plain paper can be accomplished without needing a special process.

4. Running cost is low.

5. A low noise operation can be achieved because of the non-impact mechanism.

6. A color image can be easily recorded using inks with various colors.

In a line ink-jet recording apparatus with a line recording head having a large number of ink emission orifices formed along a line (extending in the main scanning direction) perpendicular to the paper feeding direction (secondary scanning direction), recording can be performed at a further increased speed.

Furthermore, if the ink is emitted in a substantially vertical direction, then the traveling path of the emitted ink is not bent by gravitation and thus the ink strikes exactly intended point on the recording medium. As a result, the resolution is further improved.

In the ink-jet recording apparatus, ink-jet recording means (recording head) of the type in which ink is emitted by means of thermal energy generated by driving an ink emission energy generating element includes an electro-thermal conversion element, electrode, liquid flowing path wall, and a top plate which are formed using a semiconductor fabrication process such as etching, evaporation, or sputtering. According to this technique, it is possible to easily produce an ink-jet recording head having a high-density of ink emission orifices, and thus it is possible to achieve a further reduction in the size of the recording head. By taking advantage of the integrated circuit fabrication technology or microfabrication technology, it is possible to produce recording means into a long form or into a plane (two-dimensional) form. This allows recording means to be mounted in a high-density fashion.

The recoding head used in the ink-jet recording apparatus generally has an array of ink emission orifices with a small size. However, if foreign particles such as paper dust or dirt deposits on the ink emission part of the recording head, or if the ink present in the emission path increases in viscosity, then the ink emission orifices are clogged. This causes a problem in the recording operation. When a new ink cartridge for supplying ink to a recording head or a new recording head cartridge including an ink cartridge and a recording head is used for the first time, the ink flowing path from the ink cartridge to the ink emission orifices of the recording head is not expected to be in a normal state. To recover the ink flowing path into a normal state, there is provided cleaning means for removing foreign particles from the ink emission part (where ink emission orifices are formed) of the recording head, and/or there is provided recovery means for recovering the state of the ink emission orifices and the ink flowing path of the recording head.

One known cleaning means is a flexible wiper (wiping member) by which the ink emission plate of the recording head is wiped thereby cleaning it. One known recovery means is a combination of a cap and a pump wherein the cap is capable of covering the ink emission plate of the recording head and is connected to the pump such that the emission orifices can be sucked by the pump. In the recovery means having such a structure, the ink emission energy generation elements disposed in the ink emission orifices are driven so that ink is emitted from the ink emission orifices toward the cap (hereinafter such an emission process is also referred to as preliminary emission), or the ink emission orifices are sucked by the pump so as to force the ink to be discharged from the emission orifices while covering the ink emission plate with the cap, thereby eliminating the factors which can cause a failure in the recording operation. When no recording operation is performed, the recording head is placed at its home position and the ink emission orifices of the recording head are covered with the cap so that the ink emission orifices are prevented from encountering problems.

In the art of the ink-jet recording apparatus, it is also known to provide remaining ink detection means for detecting the amount of ink remaining in an ink cartridge and also provide means for informing a user of the amount of remaining ink and/or the timing of replacing the ink cartridge, depending on the detection result given by the remaining ink detection means.

The recording head cartridge and the cap serving as the recovery means used in the conventional ink-jet recording apparatus are further described below with reference to FIG. 15. In the specific example shown in FIG. 15, the recording head and the cap are formed in a small size and capable of recording a color image.

In FIG. 15, the recording head cartridge and the cap are denoted by reference numerals 11 and 20, respectively. The recording head cartridge 11 can emit a plurality of inks with colors of black (Bk), cyan (C), magenta (M), and yellow (Y).

Ink emission orifices (11*c*=Bk, 11*d*=C, 11*e*=M, 11*f*=Y) for emitting the plurality of inks are formed in a single ink emission plane 6*h*. The inks are supplied from a black (Bk) ink cartridge 12 or a color ink cartridge (three colors Y, M, C are stored in the single cartridge) 13 (refer to FIG. 2). The single cap 20 is used in common for all the ink emission orifices. When a recovering operation is performed, the cap 20 comes into contact with the ink emission plane 6*h* of the recording head cartridge 11 and the respective ink emission orifices formed in the ink emission plane 6*h* are simultaneously sucked by a pump (not shown in FIG. 15) connected to the cap 20.

Referring to the flow charts shown in FIGS. 16–18, the procedure of replacing an ink cartridge used in the conventional ink-jet recording apparatus is described below.

The procedure of replacing the ink cartridges of the conventional ink-jet recording apparatus is described below with reference to the flow charts shown in FIGS. 16 to 18.

After turning on the electric power of a new recording apparatus (step S201), a recording head cartridge 11 is set on a carriage 6 (refer to FIG. 2). Furthermore, a new black (Bk) ink cartridge 12 and color ink cartridge (in which all three color inks are stored) 13 are set on the recording head cartridge 11 (step S202). The count numbers of the remaining-ink counters V(Bk), V(Y), V(M), and V(C) of Bk, Y, M, and C (not shown) provided in the ink-jet recording apparatus are each set to maximum values (step S203).

After that, a recovering operation is performed to get the recording head recovered into a normal state. The amount of ink consumed by suction and preliminary emission in the recovering operation is calculated for each ink on the basis of the evacuating capacity of the pump 25 (refer to FIG. 2), the amount of ink per droplet, and the number of droplets emitted. The amounts of inks consumed in the recovering operation are set into the variables $V(Bk)_1$, $V(Y)_1$, $V(M)_1$, and $V(C)_1$, respectively (step S204).

The count values of the remaining-ink counters V(Bk), V(Y), V(M), and V(C) are updated by subtracting the consumed amounts from the current count values of the remaining-ink counters (step S205). The count values of the remaining-ink counters V(Bk), V(Y), V(M), and V(C) of the respective inks are checked whether they are equal to or less than zero (step S206). If the count value of any of the remaining-ink counters of ink Bk, Y, M, or C is detected to be equal to or less than zero, then the process goes to step S114.

If the count value of the remaining-ink counter V(Bk) of the Bk ink is equal to or less than zero, a message is displayed to tell that the black (Bk) ink cartridge 12 should be replaced. On the other hand, if the count value of any remaining-ink counter V(Y), V(M), or V(C) of Y, M, or C ink is equal to or less than zero, then a message is displayed to tell that the color ink cartridge 13 should be replaced. In the case where the count value of the remaining-ink counter V(Bk) of Bk ink is equal to or less than zero and the count value of any-remaining ink counter V(Y), V(M), or V(C) of Y, M, or C ink is also equal to or less than zero, a message is displayed to tell that both the black (Bk) ink cartridge 12 and the color ink cartridge should be replaced (step S207). The process then goes to step S216.

On the other hand, if it is determined in step S206 that the count values of the remaining-ink counters V(Bk), V(Y), V(M), and V(C) of Bk, Y, M, and C are all greater than zero, then the process waits in step S208 until a recording command is issued. If a recording command is received (step S209), then recording is performed on one page of recording sheet (step S210) and the amount of ink consumed in the recording operation is calculated for each ink. Herein the calculation can be accomplished on the basis of the amount of one droplet of ink and the number of droplets of each ink used in the recording operation. The amounts of inks consumed in the recording operation are substituted into the variables $V(Bk)_2$, $V(Y)_2$, $V(M)_2$, and $V(C)_2$, respectively (step S211).

After completion of the recording operation on one page of recoding sheet, the count values of the remaining-ink counters V(Bk), V(Y), V(M), and V(C) are updated by subtracting the consumed amounts from the current count values of the respective remaining-ink counters (step S212). The count values of the remaining-ink counters V(Bk), V(Y), V(M), and V(C) of the respective inks are checked whether they are equal to or less than zero (step S213). If the count value of any remaining-ink counter V(Y), V(M), or V(C) of Y, M, or C ink is equal to or less than zero, then the process goes to step S114.

If the count value of the remaining-ink counter V(Bk) of the Bk ink is equal to or less than zero, a message is displayed to tell that the black (Bk) ink cartridge 12 should be replaced. On the other hand, if the count value of any remaining-ink counter V(Y), V(M), or V(C) of Y, M, or C ink is equal to or less than zero, then a message is displayed to tell that the color ink cartridge 13 should be replaced. In the case where the count value of the remaining-ink counter V(Bk) of Bk ink is equal to or less than zero and the count value of any remaining-ink counter V(Y), V(M), or V(C) of Y, M, or C ink is also equal to or less than zero, a message is displayed to tell that both the black (Bk) ink cartridge 12 and the color ink cartridge 13 should be replaced (step S214). The process then goes to step S216.

On the other hand, if it is determined in step S213 that the count values of the remaining-ink counters V(Bk), V(Y), V(M), and V(C) of Bk, Y, M, and C are all greater than zero, then the process goes into a waiting state and waits for a recording command (step S215).

After completion of step S207 or S214, the process goes to step S216 in which the ink cartridge whose remaining amount counted by the remaining-ink counter has become zero is replaced. The count value of the remaining-ink counter associated with the replaced ink cartridge is reset to the maximum value (step S217). A recovering operation is then performed to get the ink flowing path associated with the replaced ink cartridge recovered into a normal state, and the amount of ink consumed in the recovering operation is calculated (step S218). The count values of the remaining-ink counters V(Bk), V(Y), V(M), and V(C) are updated by subtracting the consumed amounts from the current count values of the remaining-ink counters (step S219).

The count values of the remaining-ink counters V(Bk), V(Y), V(M), and V(C) of the respective inks are checked whether they are equal to or less than zero (step S220). If the count value of any of remaining-ink counters of Bk, Y, M, or C ink is detected to be equal to or less than zero, then the process goes to step S114.

If the count value of the remaining-ink counter V(Bk) of the Bk ink is equal to or less than zero, a message is displayed to tell that the black (Bk) ink cartridge 12 should be replaced. On the other hand, if the count value of any remaining-ink counter V(Y), V(M), or V(C) of Y, M, or C ink is equal to or less than zero, then a message is displayed to tell that the color ink cartridge 13 should be replaced. In the case where the count value of the remaining-ink counter V(Bk) of Bk ink is equal to or less than zero and the count value of any remaining-ink counter V(Y), V(M), or V(C) of Y, M, or C ink is also equal to or less than zero, a message is displayed to tell that both the black (Bk) ink cartridge 12 and the color ink cartridge 13 should be replaced (step S221). The process then goes to step S216.

On the other hand, if it is determined in step S220 that the count values of the remaining-ink counters V(Bk), V(Y), V(M), and V(C) of Bk, Y, M, and C are all greater than zero, then the process goes into a waiting state and waits for a recording command (step S222).

In either step S206, 213, or 220, described above, if it is determined that the count value of at least one of the remaining-ink counters V(Y), V(M), V(C) associated with inks Y, M or C in the color ink cartridge or the count value of the remaining-ink counter V(Bk) of the Bk ink is equal to or less than zero and that although the count value of some remaining-ink counter is greater than zero, it is less than the amount of ink (Bk: $V(Bk)_1$, Y: $V(Y)_1$, M: $V(M)_1$, C: $V(C)_1$) used in the recovering operation, the ink cartridge that was determined by the remaining-ink counter to have no remaining ink is replaced in step S216, and the count value of the remaining-ink counter associated with the replaced ink cartridge is reset to the maximum value in step S217. Then in step S218, the recovering operation is performed and the amounts of ink used in the recovering operation are calculated. In the following step S219, the values of the respective remaining-ink counters are updated according to the calculation result. In this case, when the process goes to step S220, the count value of the remaining-ink counter of the ink cartridge which was not replaced becomes equal to or less than zero. Thus the process goes to step S221 and a message telling that the ink cartridge should be replaced is displayed. Subsequently, steps S216 to S220 are again performed. After that, the process waits in step S222 until a recording command is issued. Depending on the amounts of remaining inks, as described above, there is a possibility that another ink cartridge is required to be replaced immediately after replacing some ink cartridge, before starting a recording operation.

The procedure described above with reference to FIGS. 16–18 has the following problems.

1. After replacing some ink cartridge, it is desirable to perform a recovering operation to get the ink flowing path associated with the replaced ink cartridge recovered into a normal state. However, the recovering operation causes a reduction in the remaining amount of inks of the ink cartridges which were not replaced. As a result, it is often required to replace another ink cartridge immediately after the replacement of one ink cartridge. When another ink cartridge is replaced immediately after replacing one ink cartridge, the ink cartridge which was first replaced is subjected to two successive recovering operations before restarting the recording operation and thus the ink is wasted.

2. When another ink cartridge is replaced immediately after replacing one ink cartridge, the recovering operation is successively performed twice and thus the total time needed for the recovering operation becomes longer.

Japanese Patent Laid-Open No. 9-156126 discloses a technique in which the amount of remaining ink is monitored for each of a plurality of color inks and the remaining amount is indicated for each color wherein if the remaining amount of some ink becomes smaller than a predetermined value, the user is informed that the ink cartridge should be replaced. The patent also discloses a technique of informing the user that the amount of remaining ink has decreased to a considerably low level at a proper time before it becomes necessary to replace the ink cartridge. However, in this technique disclosed in the patent cited above, information is presented to the user only about the ink cartridge of a plurality of ink cartridges which has become smaller in the remaining amount than the predetermined value, and the possibility of a problem is not taken into account that can occur due to a reduction in the amount of remaining ink during the recovering operation performed after the replacement of an ink cartridge.

In Japanese Patent Laid-Open No. 5-16384, there is disclosed a technique in which the amount of remaining ink is monitored for each of a plurality of inks, and if an ink with a certain color is detected to be smaller in the remaining amount than a predetermined value, information is presented to the user that the ink cartridge should be replaced after further performing a certain amount of recording operation. The patent cited above also discloses a technique in which if the remaining amount of another color ink is detected to become less than the predetermined value during the recording operation performed after the detection of a reduction in the remaining amount of a certain color ink, a message is also displayed to tell that the ink cartridge of that color should also be replaced. However, the problem described earlier is not taken into account even in this patent.

In U.S. Pat. No. 5,414,452, a technique is disclosed in which the amount of remaining ink is detected on the basis of the number of ink droplets emitted and the reduction in the amount of ink due to evaporation. However, the problem described above is not take into account also in this patent.

SUMMARY OF THE INVENTION

In view of the above, it is a general object of the present invention to solve the above-described problems. More specifically, it is an object of the present invention to provide a recording apparatus and a method of controlling the operation of the recording apparatus in which the timing of replacing ink storage means which stores ink used by a recording head or the timing of refilling it with ink is properly controlled so as to minimize the amount of ink and the time needed in the recovering operation thereby achieving a high efficiency in the operation of recovering the recording head thus minimizing the number of operations performed by a user to replace an ink cartridge or refill it with ink.

According to an aspect of the present invention, there is provided a recording apparatus for performing a recording operation using a recording head for emitting ink, the recording apparatus including:

a mounting unit for replaceably mounting a plurality of ink storage means for storing ink supplied to the recoding head;

remaining amount detection means for detecting the amount of ink remaining in each of the plurality of ink storage means; and judgement means for determining whether it is required to replace some of the plurality of ink storage means on the basis of the detection result given by the remaining detection means, wherein said judgement means determines whether the amount of ink remaining in some of the plurality of ink storage means has decreased to such an extent that the ink storage means has to be replaced, and if it is determined that there is ink storage means which should be replaced, the judgement means determines that another ink storage means whose remaining ink is lower than a predetermined value should also be replaced; and informing means for presenting information about the ink storage means which should be replaced, in accordance with the judgement result given by the judgement means.

Preferably, the recording apparatus further includes recovery means for recovering the emission conditions of the recording head by means of discharging ink from the recording head, after the replacement of ink storage means, and the predetermined value described above is determined depending on the amount of ink discharged from the recording head during the recovering operation performed after the replacement of the ink storage means.

According to another aspect of the present invention, there is provided a recording apparatus for performing a recording operation using a recording head for emitting ink, the recording apparatus including:

a plurality of ink storage means for storing ink supplied to the recoding head;

remaining amount detection means for detecting the amount of ink remaining in each of the plurality of ink storage means; and judgement means for determining whether it is required to refill some of the plurality of ink storage means with ink on the basis of the detection result given by the remaining detection means, wherein the judgement means determines whether the amount of ink remaining in some of the plurality of ink storage means has decreased to such an extent that the ink storage means should be refilled with ink, and if it is determined that there is ink storage means which should be refilled with ink, the judgement means determines that another ink storage means whose remaining ink is lower than a predetermined value should also be refilled with ink; and informing means for presenting information about the ink storage means which should be refilled with ink, in accordance with the judgement result given by the judgement means.

According to still another aspect of the present invention, there is provided a method of controlling a recording apparatus, the recording apparatus including a mounting unit for replaceably mounting a plurality of ink storage means for storing ink, the recording apparatus being adapted to perform a recording operation using a recording head for emitting ink supplied from the ink storage means, the method comprising the steps of:

detecting the amount of ink remaining in each of the plurality of ink storage means;

judging whether replacement is required on each of the plurality of ink storage means on the basis of the detection result obtained in the step of detecting the amount of remaining ink, wherein in the judgement step it is determined whether the amount of ink remaining in some of the plurality of ink storage means has decreased to such an extent that the ink storage means has to be replaced, and if it is determined that there is ink storage means which should be replaced, it is further determined that another ink storage means whose remaining ink is lower than a predetermined value should also be replaced; and presenting information about the ink storage means which should be replaced, in accordance with the judgement result made in the judgement step.

According to still another aspect of the present invention, there is provided a method of controlling a recording apparatus, the recording apparatus including a plurality of ink storage means for storing ink, the recording apparatus being adapted to perform a recording operation using a recording head for emitting ink supplied from the ink storage means, the method comprising the steps of:

detecting the amount of ink remaining in each of the plurality of ink storage means;

judging whether some of the plurality of ink storage means should be refilled with ink on the basis of the detection result obtained in the step of detecting the amount of remaining ink, wherein in the judgement step it is determined whether the amount of ink remaining in some of the plurality of ink storage means has decreased to such an extent that the ink storage means should be refilled with ink, and if it is determined that there is ink storage means which should be refilled with ink, the judgement means determines that another ink storage means whose remaining ink is lower than a predetermined value should also be refilled with ink; and presenting information about the ink storage means which should be refilled with ink, in accordance with the judgement result made in the judgement step.

In the present invention, as described above, the amount of remaining ink is monitored for each ink cartridge. If an ink cartridge is detected to be so low in the amount of remaining ink that it should be replaced or refilled, then it is judged whether there is another ink cartridge whose amount of remaining ink is lower than a predetermined value. If there is such an ink cartridge, it is determined that the ink cartridge as well as the former one should also be replaced or refilled with ink. In accordance with the judgement result, information is presented about the ink cartridge which should be replaced or refilled.

As opposed to conventional techniques in which there is a possibility that an ink cartridge runs out ink during a recovering operation performed after another ink cartridge was replaced or refilled with ink and thus it is further required to be replaced or refilled, the technique according to the present invention makes it possible to replace or refill ink cartridges in a highly efficient manner.

DESCRIPTION OF THE PREFERRED EMBODIMENT

The present invention is described in further detail below with reference to preferred embodiments in conjunction with the accompanying drawings.

First Embodiment

Figure 1:
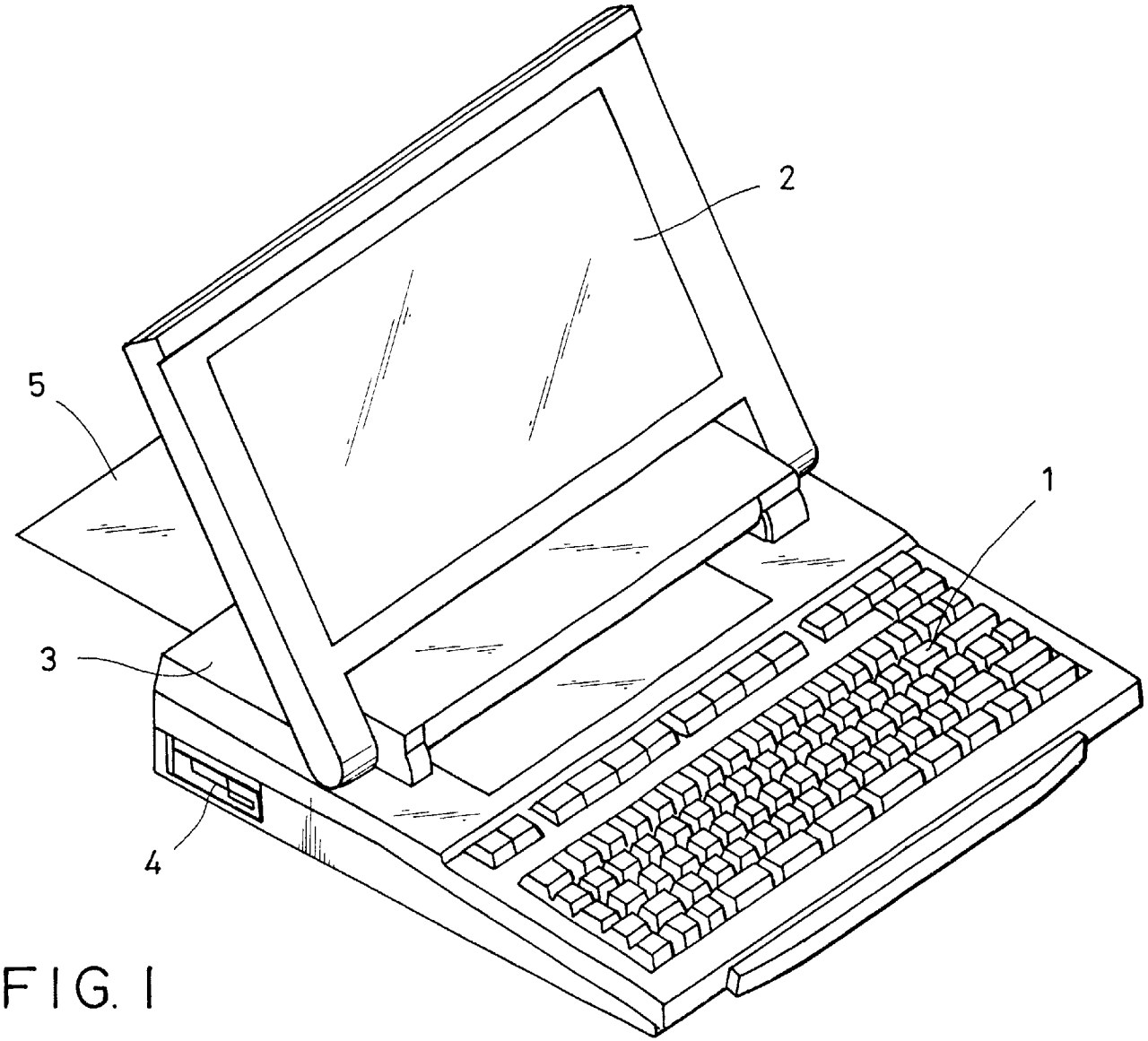
FIG. 1 is a perspective view illustrating a word processor provided with a recording apparatus according to an embodiment of the invention.

FIG. 1 is a perspective view illustrating a word processor provided with a recording apparatus according to a first embodiment of the invention.

The general structure of the apparatus is first described below. As shown in FIG. 1, the recording apparatus includes an input device provided with a keyboard 1 used to input information, a display 2 such as an LCD for displaying information, a storage device such as a floppy disk drive 4 for storing input information, and a recording apparatus 3 for recording input information on a recording medium 5. In this apparatus, if character data is input via the keyboard 1, information is displayed on the display 2 in accordance with the input information. After setting a recording medium (hereinafter also referred to as a recording sheet) 5 on the recording apparatus 3, if a start key (not shown) provided on the keyboard 1 is pressed, then the recording apparatus 3 starts to record the input information on the recording medium 5.

The detailed structure of the ink-jet recording apparatus 3 according to the present embodiment of the invention is described below with reference to FIG. 2.

Figure 2:
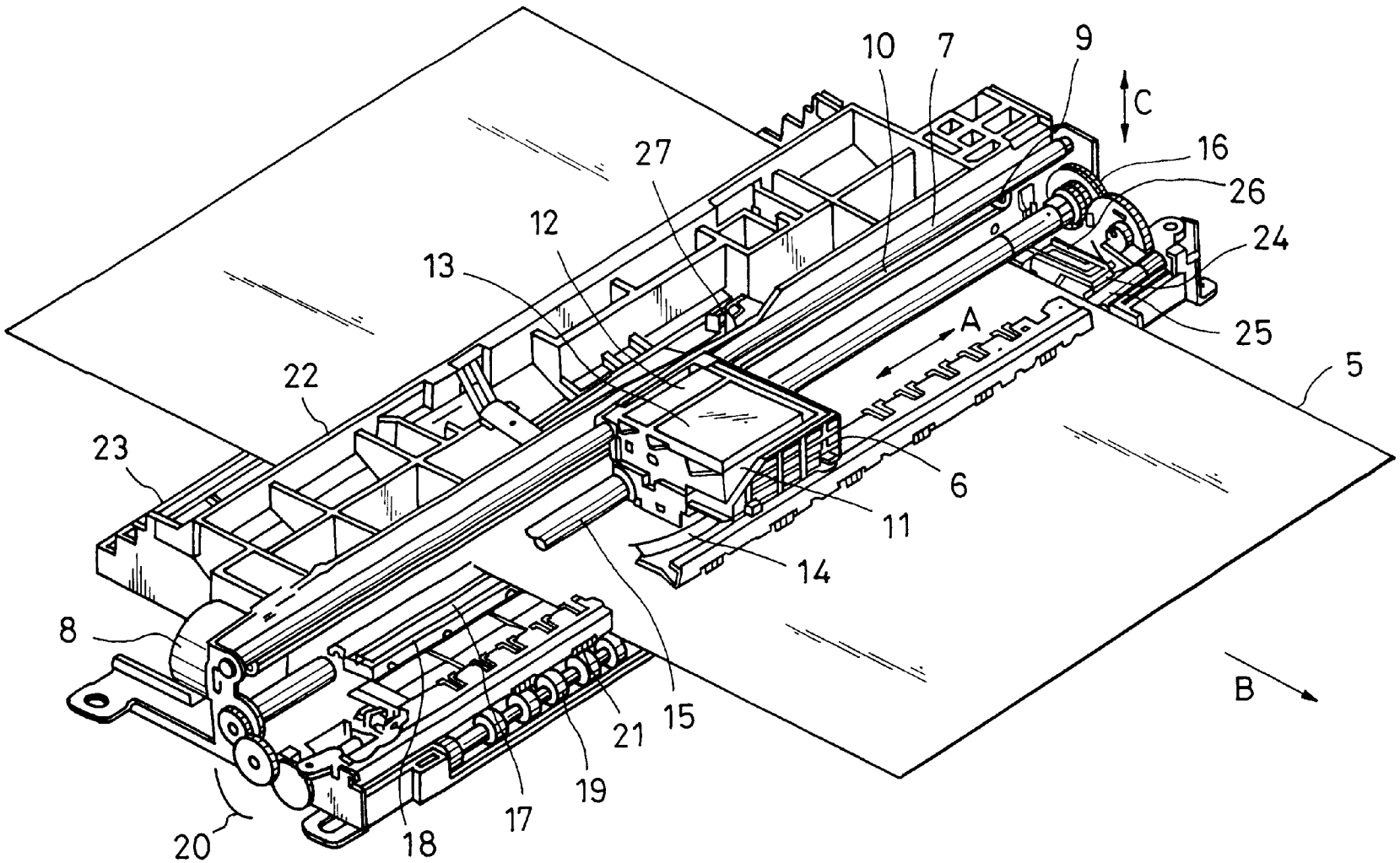
FIG. 2 is a schematic diagram illustrating a recording apparatus according to a first embodiment of the invention.

In FIG. 2, reference numeral 6 denotes a carriage supported by a guide shaft 7. A part of the carriage 6 is connected to a carriage driving belt 10 extending between a carriage driving motor 8 and a pulley 9 so that the carriage 6 can move in both directions along the guide shaft 7 in response to the rotation of the carriage driving motor 8.

A recording head cartridge 11 is removably mounted on the carriage 6 in such a manner that inks are emitted downward through ink emission orifices (not shown in FIG. 2). The recording head cartridge 11 is capable of forming a colored image by emitting inks with four colors of Bk (black), Y (yellow), M (magenta), and C (cyan) onto a recording sheet 5. The structure of the recording head cartridge will be described in detail later. A Bk (black) ink cartridge 12 in which black ink is stored is removably mounted on the recording head cartridge 11 so that the black ink is supplied to the recording head cartridge 11. A color ink cartridge 13 in which three different inks with colors of Y (yellow), M (magenta), and C (cyan) are all stored is also mounted on the recording head cartridge 11 in a removable fashion and such that these three color inks are supplied to the recording head cartridge 11. The recording head cartridge 11 is electrically connected to a control circuit board (not shown) via a flexible circuit film 14.

A carrying roller 15 is connected to a recording sheet feeding motor (not shown) via a driving force transmission mechanism such as a Grear train 16. A pinch roller 17 is rotatably supported on a pinch roller holder 18. The pinch roller 17 is urged toward the carrying roller 15 by an urging element (not shown). A paper feeding-out roller 19 is connected to the carrying roller 15 via a gear train 20 serving as a driving force transmission mechanism. The paper feeding-out roller 19 is urged toward spurs 21 by an urging element (not shown).

A recording sheet 5 is fed into a paper input slit between upper and lower guide members 22 and 23, and moves in a direction shown by an arrow B in response to the rotation of the recording sheet feeding motor, while being pinched between the carrying roller 15 and the pinch roller 17 and between the paper feeding-out roller 19 and the spurs 21.

The recording operation performed by the recording apparatus 3 is briefly described below.

First, a recording sheet 5 is fed into the paper input slit and moved until its leading end comes into contact with the nip between the carrying roller 15 and the pinch roller 17. After that, as the carrying roller 15 rotates in response to the rotation of the recording sheet feeding motor, the recording sheet 5 moves toward a recording position immediately below the recording head cartridge 11. The carriage 6 is then scanned along the guide shaft 7 so as to perform a recording operation along one line. After completion of the recording operation along one line, the recording sheet 5 is carried to the next recording position, and the carriage 6 is again scanned along the guide shaft 7 thereby performing the recording operation for the next line. The above operation is performed repeatedly until the recording operation is completed for the whole page.

The structure of the recording apparatus 3 is described in further detail below. the detailed structure of the recording head cartridge 11 is also described.

A cap 24 is disposed out of the area where the recording sheet 5 passes. The cap 24 can be driven by the recording sheet feeding motor via a clutch mechanism (not shown) so as to move in directions denoted by C. The cap 24 communicates in series with a pump 25 used to recover the recording head cartridge 11 and also with a waste ink tank (not shown) in which undesirable ink sucked by the pump 25 is stored Referring now to FIG. 3, the detail structure of the recording head cartridge 11 according to the present embodiment is described.

Figure 3:
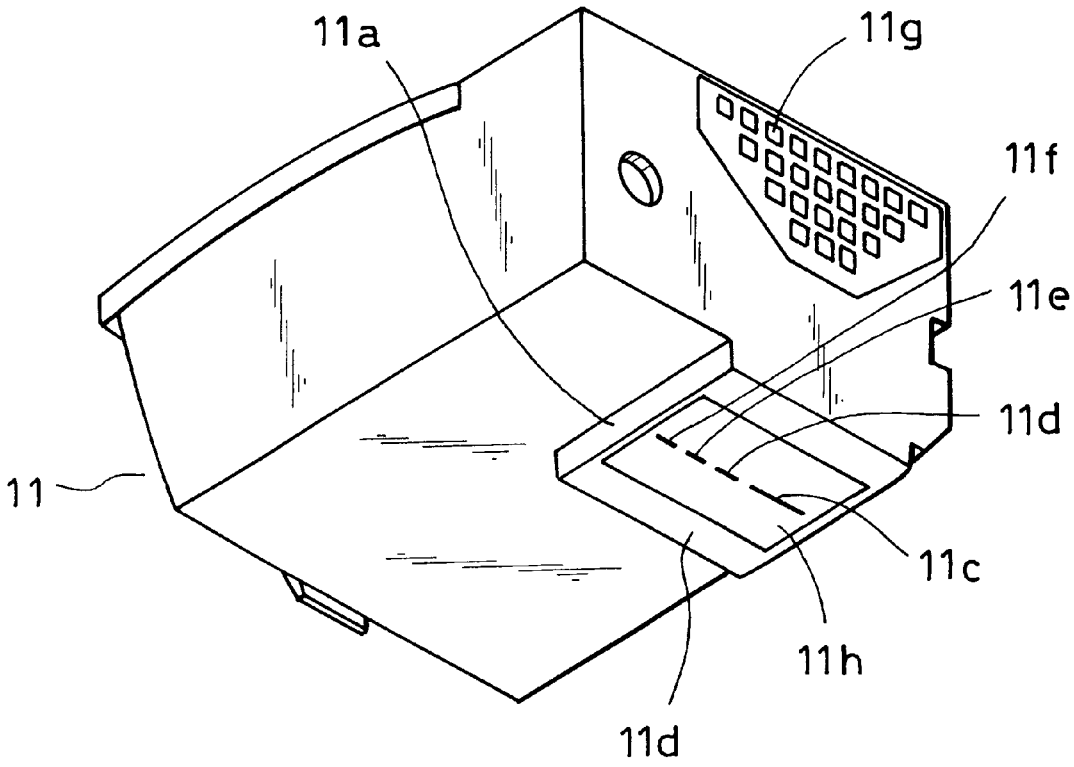
FIG. 3 is a perspective view illustrating the details of the recording head cartridge according to the first embodiment of the invention.

FIG. 3 is a perspective view of the recording head cartridge 11 seen from blow.

Reference numeral 11*a* denotes a recording head having an ink emission part h formed on the side 11*b* facing the recording sheet 5. The ink emission part h includes a linear array of nozzles 11*c* for emitting black (Bk) ink, nozzles 11*d* for emitting cyan (C) ink, nozzles 11*e* for emitting magenta (M) ink, and nozzles 11*f* for emitting yellow (Y) ink which are arranged along a straight line. The cap 24 shown in FIG. 2 is adapted to cover the ink emission part 11*h* so as to protect the series of nozzles 11*c*, 11*d*, 11*e*, and 11*f*. Reference numeral 11*g* denotes a plate (on which electrode pads are formed) via which the electrical connection to the flexible circuit film 14 shown in FIG. 2 is achieved.

In the specific example shown in FIG. 3, the linear array of nozzles 11*c* for emitting black ink is formed along a longer length than the arrays of nozzles 11*d*, 11*e*, and 11*f* for emitting color inks so that there are a greater number of nozzles 11*c* for emitting black ink than the nozzles for emitting color inks. In many cases, images recorded by the recording apparatus include only a black component as in the case of a textual document or a line drawing. It is possible to achieve a high-speed recording operation for a black image by forming a greater number of nozzles for emitting black ink as shown in FIG. 3.

The structure of the recording apparatus 3 is further described below with reference to FIGS. 2 and 3.

The operation of covering the ink emission part h with the cap 24 (this operation is also referred to simply as capping) is performed by moving the recording head cartridge 11 mounted on the carriage 6 to a location (capping position) where the ink emission orifices 11*c*, 11*d*, 11*e*, and 11*f* are just above the cap 24, and then moving the cap 24 until the cap 24 comes into contact with the ink emission part (ink emission plane) 11*h* of the recording head cartridge 11. When the recovering operation is accomplished, the pump 25 is operated while the ink emission part h is covered with the cap 24 so that ink is sucked from the ink emission orifices 11*c*–11*f*. In the recovering operation, all inks of colors Bk, Y, M, and C are simultaneously sucked and consumed.

In FIG. 2, reference numeral 26 denotes a wiper which moves, depending on the motion of the carriage 6, toward and apart from the location in contact with the ink emission part 11*h* of the recording head cartridge 11. Dust and dirt can be removed (wiped) from the ink emission part 11*h* by moving the carriage 6 while the wiper 26 is kept in contact with the ink emission part 11*h* of the recording head cartridge 11. Reference numeral 27 denotes a paper sensor for detecting whether there is a recording sheet.

The control circuit which controls the operation of the recording apparatus 3 is described with reference to FIG. 4.

Figure 4:
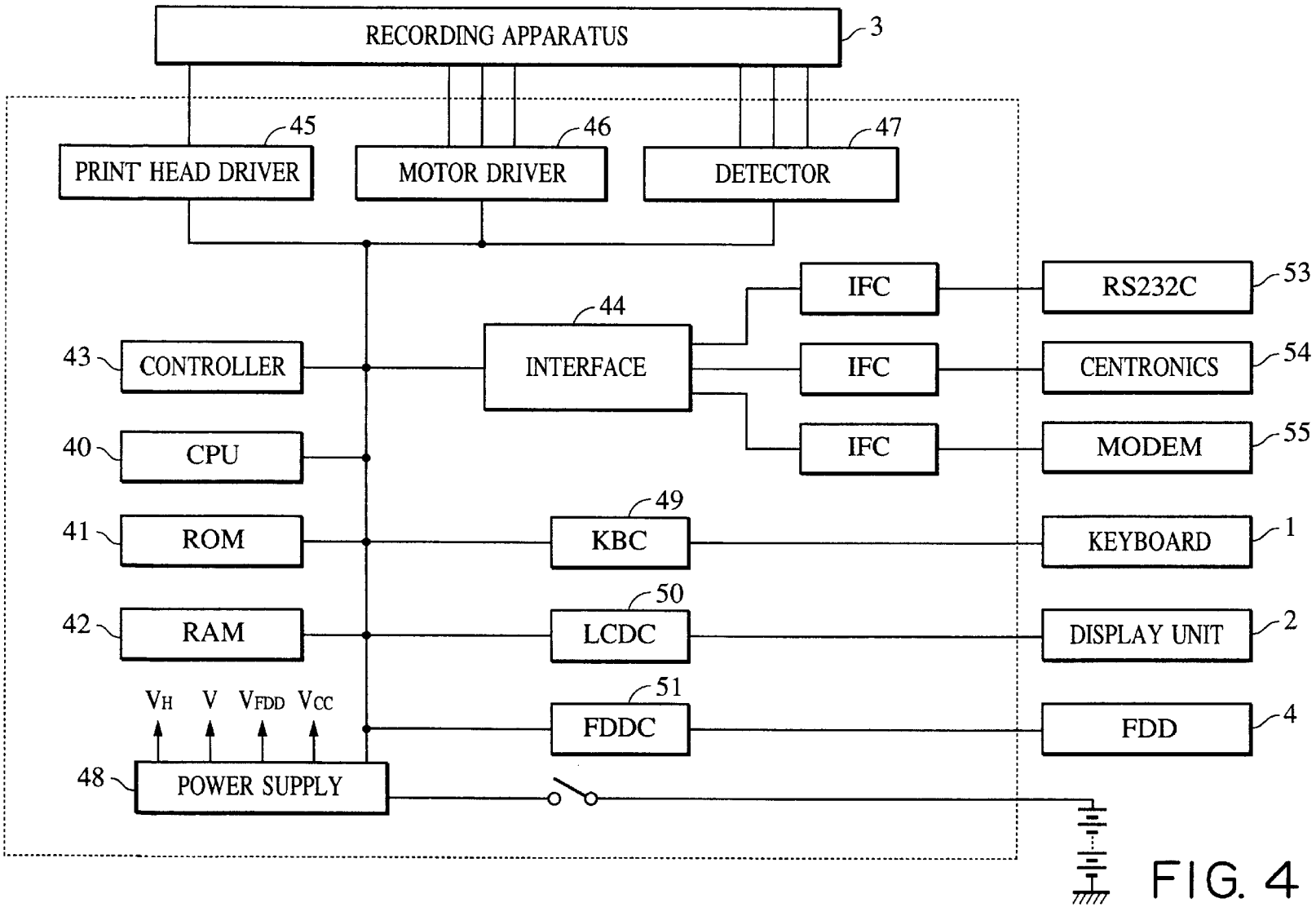
FIG. 4 is a block diagram illustrating a control circuit according to the first embodiment of the invention.
Figure 5:
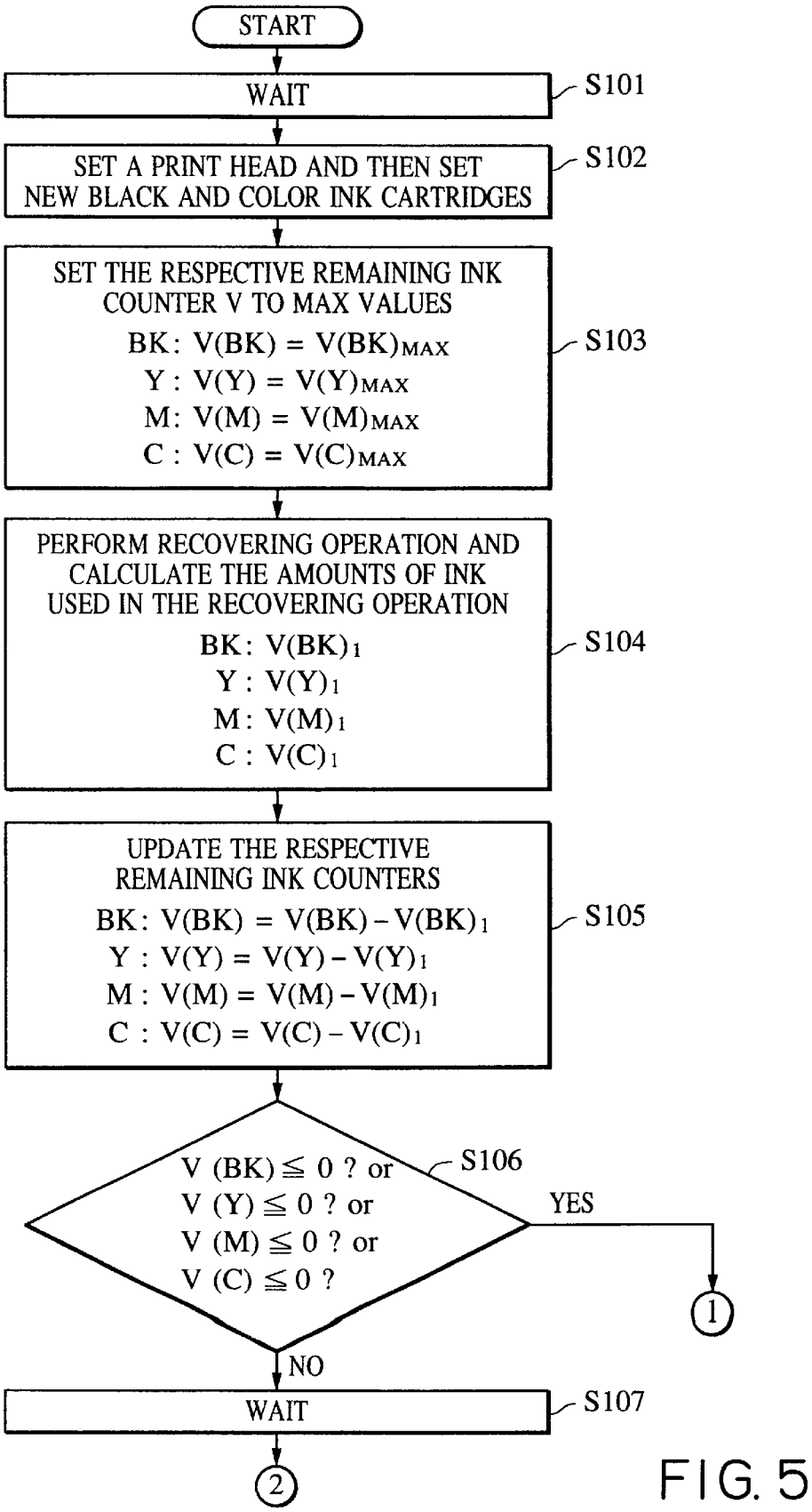
FIGS. 5–8 are flow charts illustrating the procedure of replacing ink cartridges according to the first embodiment of the invention.

FIG. 4 is a block diagram illustrating the configuration of the control circuit according to the present embodiment.

In the block diagram shown in FIG. 4, only the relationship between the respective blocks is shown in a simplified fashion, although there are a greater number of control lines in the actual circuit. The control circuit includes a CPU unit surrounded by a broken line in FIG. 4.

A CPU (central processing unit) 40 reads a program and various data from a ROM 41 which will be described later or a floppy disk driver (FD) 4 and performs various calculations and processes required in the recording operation.

The ROM (read only memory) 41 stores various programs and data such as character codes and dot patterns (character generator, CG) which are used by the CPU 40 to perform the recording operation.

A RAM (random access memory) 42 is a memory capable of reading and writing data from and to it, and includes various memory areas such as a working area used by the CPU 40 to temporarily store data or calculation results, buffer area for storing various data input from a keyboard 1, interface 44, or floppy disk driver 4, and a text area for storing text data. The CPU unit is connected to the recording apparatus 3 via the recording head driver 45, the motor driver 46, and the detector 47.

Under the control of the CPU 40, the recording head driver 45 drives the recording head cartridge 11 mounted on the recording apparatus 3, and the motor driver 46 drives the carriage driving motor 8 and the recording sheet carrying motor (not shown).

The detector 47 receives information from a carriage sensor (not shown) disposed in the recording apparatus 3 to detect the position of the carriage 6 and also information from the paper sensor 27 for detecting the presence of a recording sheet 5, and transfers the received information to the CPU 40.

A power supply 48 provides a power supply voltage VH for driving the recording head cartridge 11, a power supply voltage VM for driving the carriage driving motor 8 and the recording sheet feeding motor, a power supply voltage VFDD for driving the floppy disk driver 4, and a power supply voltage VCC for driving the other logic circuits.

Under the control of the CPU 40, a controller 43 transfers data used by the recording head cartridge to perform the recording operation and also controls the voltage or current the driving power supply VH.

The CPU unit is connected via a keyboard connector (KBC) 49 to the keyboard 1 serving as an input device for inputting various data required in the recording or editing operation. The CPU unit is also connected via a LCD connector (LCDC) 50 to a display 2 constructed with an LCD for displaying the data input via the keyboard 1 and various, information. Instead of the LCD, a CRT or other display devices may also be employed as the display 2. The CPU unit is also connected via a floppy disk driver connector (FDDC) 51 to the floppy disk driver 4. Instead of the floppy disk, another type of storage medium such as a hard disk or an external RAM may be connected.

The CPU unit may be connected to interfaces such as RS232C53, Centronics 54, and a modem 55 via an interface connector (IFC) 52 so that the recording apparatus 3 can be controlled by an external controller and the CPU unit can communicate with an external device.

The procedure of replacing an ink cartridge used in the ink-jet recording apparatus 3 according to the first embodiment is described below referring to the flow charts shown in FIGS. 5–8.

After turning on the electric power of a new recording apparatus (step S101), a recording head cartridge 11 is set on a carriage 6. Furthermore, a new black (Bk) ink cartridge 12 and color ink cartridge (in which all three color inks are stored) 13 are set on the recording head cartridge 11 (step S102). The count numbers of the remaining-ink counters V(Bk), V(Y), V(M), and V(C) of Bk, Y, M, and C (not shown) provided in the ink-jet recording apparatus are each set to maximum values (step S103). The maximum value is selected to be less than the lowest value of the variation in the amount of ink filled in each ink cartridge so that if the count values of the remaining-ink counters are greater than zero, the actual amounts of ink never become zero.

A recovering operation is performed to get the recording head 11*a* recovered into a normal state. The amount of ink consumed by suction and preliminary emission in the recovering operation is calculated for each ink on the basis of the evacuating capacity of the pump 25, the amount of each droplet of ink, and the number of droplets emitted. The amounts of inks consumed in the recovering operation are set into the variables $V(Bk)_1$, $V(Y)_1$, $V(M)_1$, and $V(C)_1$, respectively (step S104).

The count values of the remaining-ink counters V(Bk), V(Y), V(M), and V(C) are updated by subtracting the consumed amounts from the current count values of the remaining-ink counters (step S105). The count values of the remaining-ink counters V(Bk), V(Y), V(M), and V(C) of the respective inks are checked whether they are equal to or less than zero (step S106). If the count value of any of the remaining-ink counters of ink Bk, Y, M, or C is detected to be equal to or less than zero, then the process goes to step S114 (shown in FIG. 7). On the other hand, if it is determined that the count values of the remaining-ink counters V(Bk), V(Y), V(M), and V(C) of Bk, Y, M, and C are all greater than zero, then the process goes into a waiting state and waits for a recording command (step S107).

Figure 6:
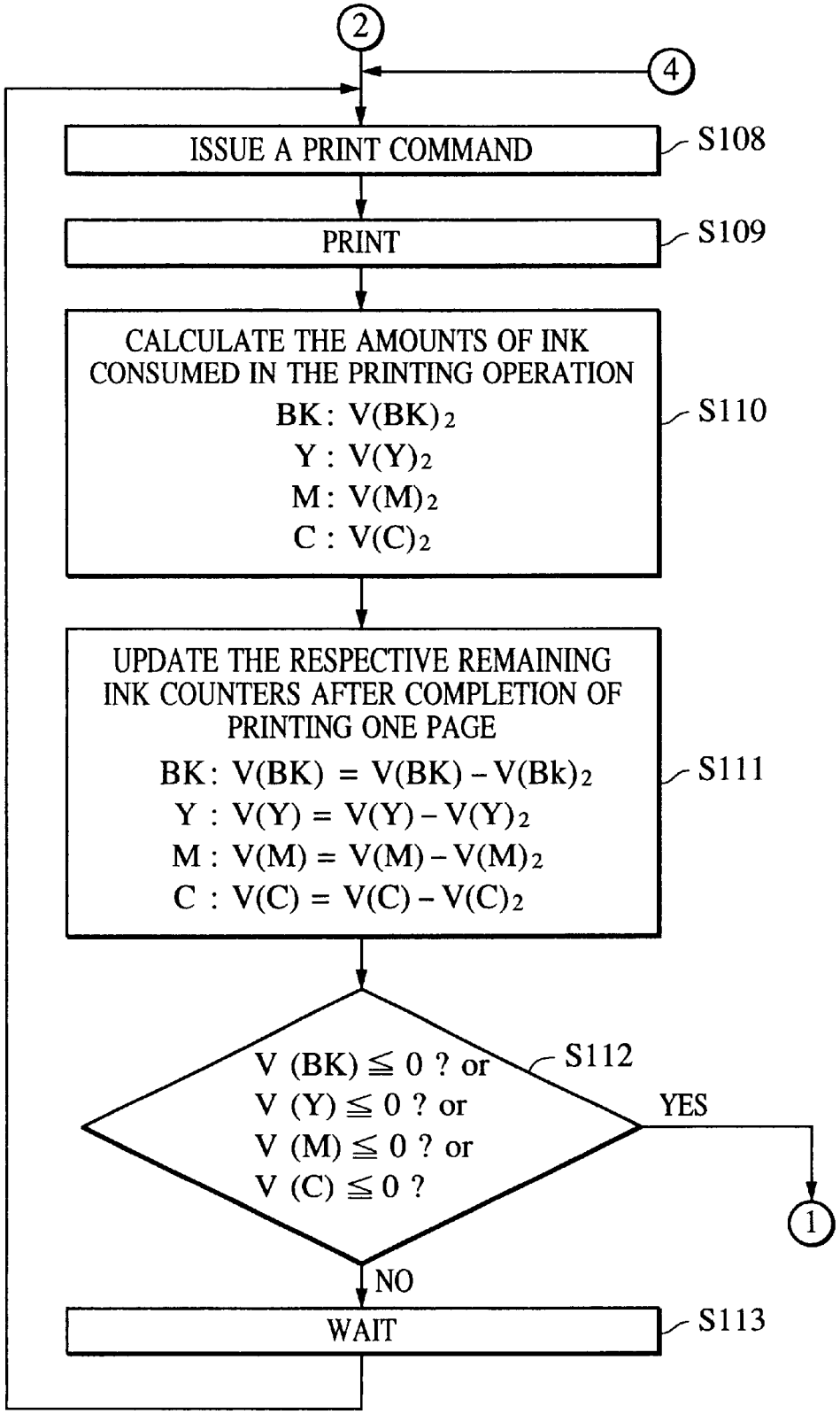
Figure 7:
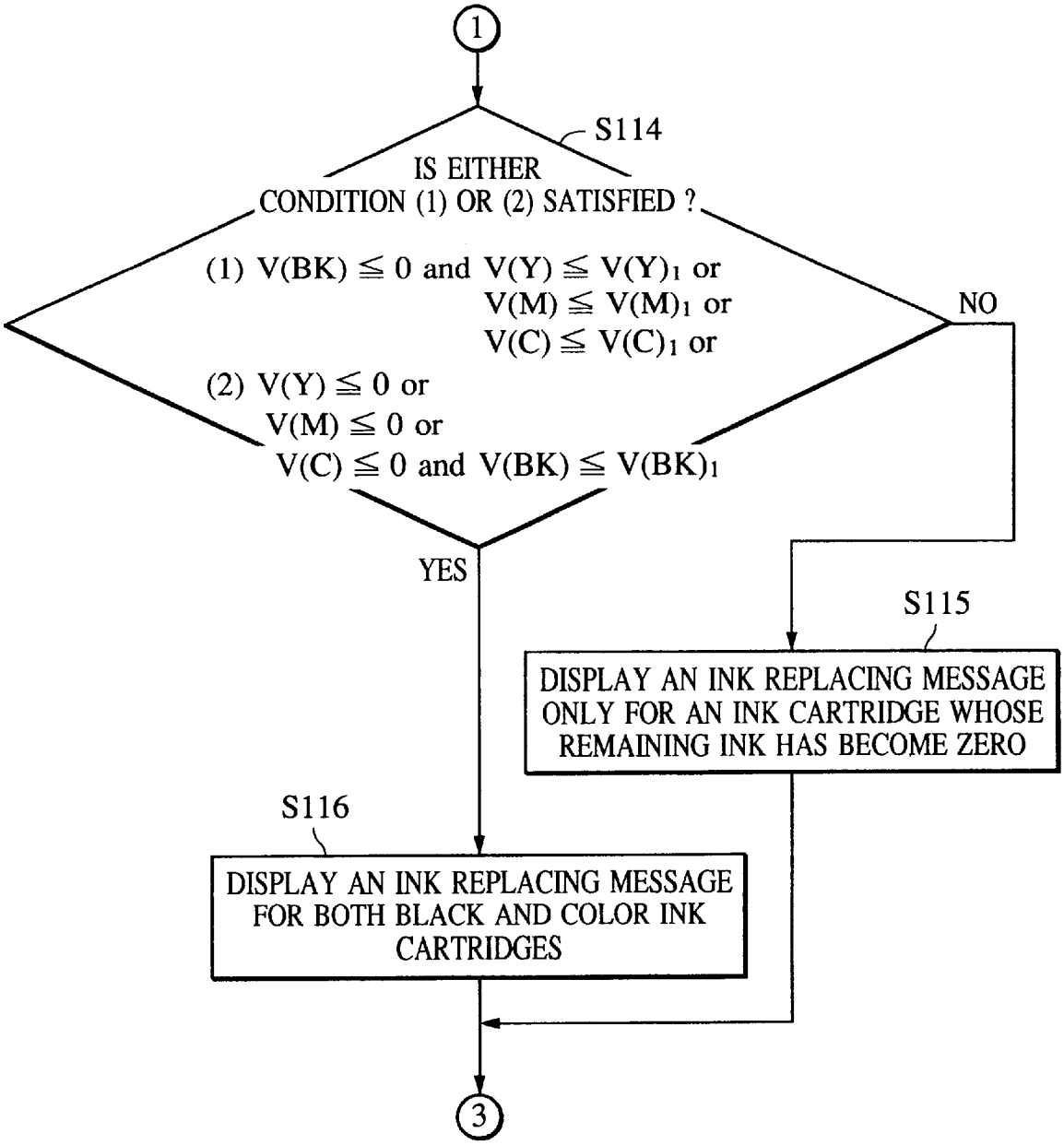
Figure 8:
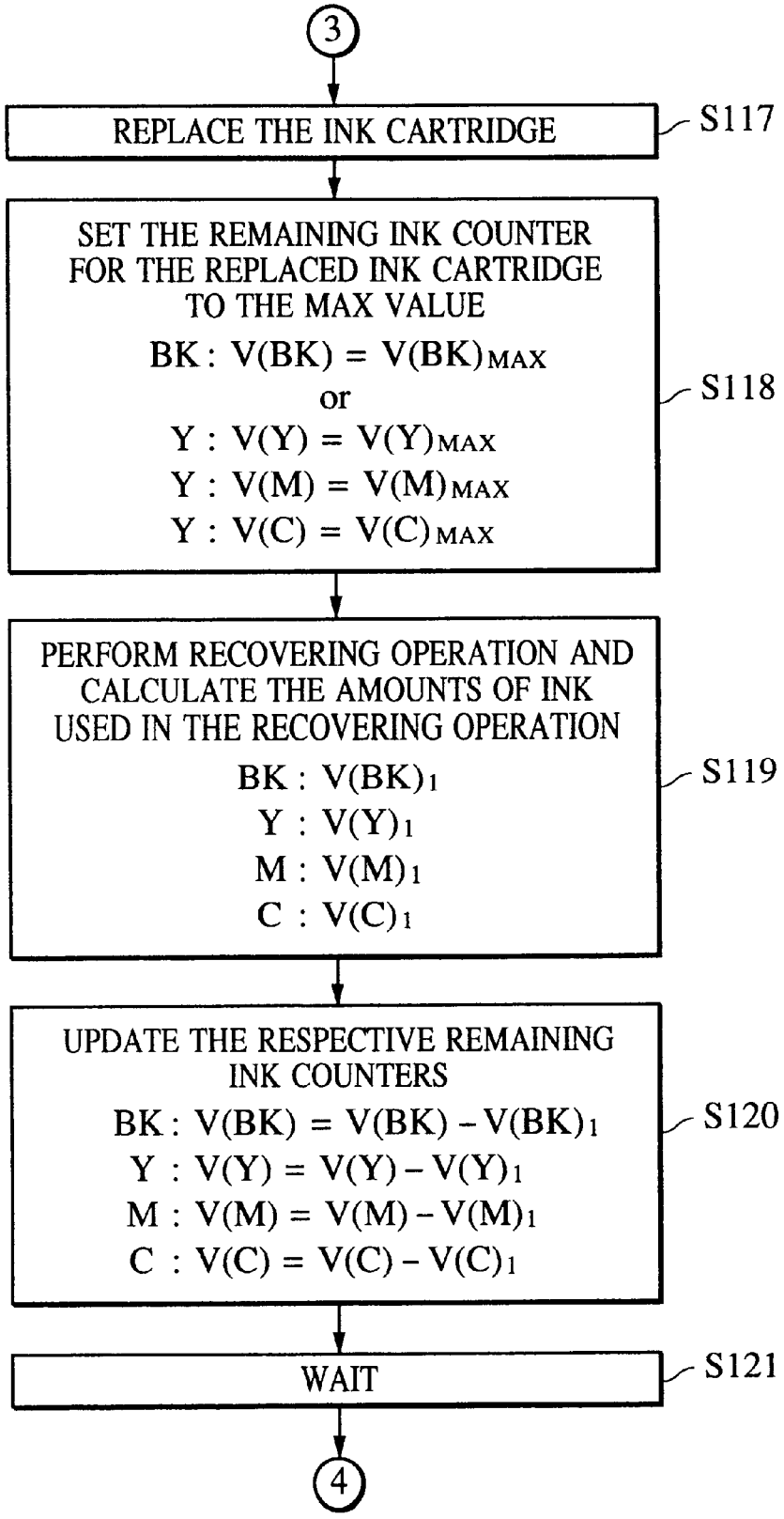

The calculation of the amount of ink consumed in the recording operation is described below with reference to the flow chart shown in FIG. 6.

If a recording command is received (step S108), then recording is performed on one page of recording sheet (step S109) and the amount of ink consumed in the recording operation is calculated for each ink. Herein the calculation can be accomplished on the basis of the amount of one droplet of ink and the number of droplets of each ink used in the recording operation. The amounts of inks consumed in the recording operation are substituted into the variables $V(Bk)_2$, $V(Y)_2$, $V(M)_2$, and $V(C)_2$, respectively (step S110).

After completion of the recording operation on one page of recoding sheet, the count values of the remaining-ink counters V(Bk), V(Y), V(M), and V(C) are updated by subtracting the consumed amounts from the current count values of the respective remaining-ink counters (step S111). The count values of the remaining-ink counters V(Bk), V(Y), V(M), and V(C) of the respective inks are checked whether they are equal to or less than zero (step S112). If the count value of any of the remaining-ink counters of ink Bk, Y, M, or C is detected to be equal to or less than zero, then the process goes to step S114. On the other hand, if it is determined that the count values of the remaining-ink counters V(Bk), V(Y), V(M), and V(C) of inks Bk, Y, M, and C are all greater than zero, then the process goes into a waiting state and waits for a recording command (step S113).

In step S106 or S112, if the count value of any remaining-ink counter V(Y), V(M), or V(C) of ink Y, M, or C is equal to or less than zero, then the process goes to step S114. In step S114, the count value of the remaining-ink counter having a value greater than zero is compared with the amount of ink consumed in the recovering operation.

If the count value of the remaining-ink counter is greater than the amount of ink consumed in the recovering operation, a message is displayed on a display 2 to tell that only the ink cartridge with no remaining ink should be replaced. For example, if the Bk ink becomes zero in the remaining amount, a message such as "Black ink has run out. Please replace it." is displayed on the display 2 thereby giving information about the ink which should be replaced (step S115). However, if the count value of the remaining-ink counter is smaller than the amount of ink consumed in the recovering operation, a message is displayed on the display 2 to tell that both ink cartridges should be replaced (step S116). Referring now to the flow chart shown in FIG. 8, the operation of replacing ink cartridges is described below. After the ink cartridge was replaced in accordance with the message in step S117, the count value of the remaining-ink counter associated with the replaced ink cartridge is reset to the maximum value (step S118). The recovering operation is then performed to get the ink flowing path associated with the replaced ink cartridge recovered into a normal state, and the amount of ink consumed in the recovering operation is calculated (step S119). The count values of the remaining-ink counters V(Bk), V(Y), V(M), and V(C) are updated by subtracting the consumed amounts from the current count values of the remaining-ink counters (step S120).

In this particular case, since the count values of the remaining-ink counters V(Bk), V(Y), V(M), and V(C) are each greater than zero, the process goes into a waiting state and waits for a recording command (step S121).

In the present embodiment, as described above, a message telling that both ink cartridges should be replaced at the same time is presented depending on the amounts of ink remaining in the respective ink cartridges thereby preventing two different ink cartridges from being replaced at different but immediately successive times, as opposed to the conventional technique, thus preventing the ink and time from being wasted.

Second Embodiment

The invention is further described below with reference to a second embodiment in conjunction with the accompanying drawings.

Figure 9:
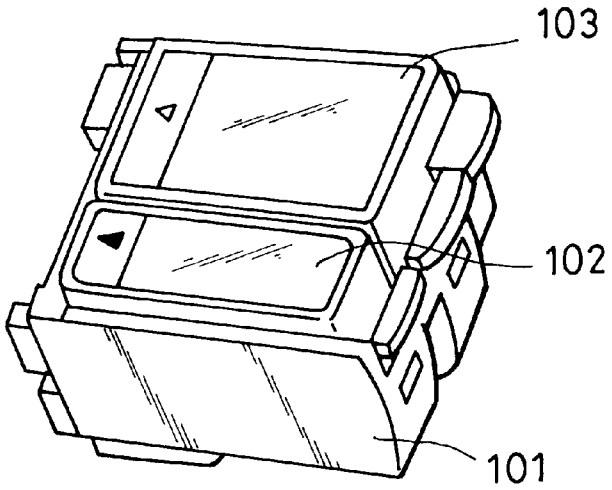
FIGS. 9 and 10 are perspective views illustrating the detailed structure of a recording head cartridge according to a second embodiment of the invention.
Figure 10:
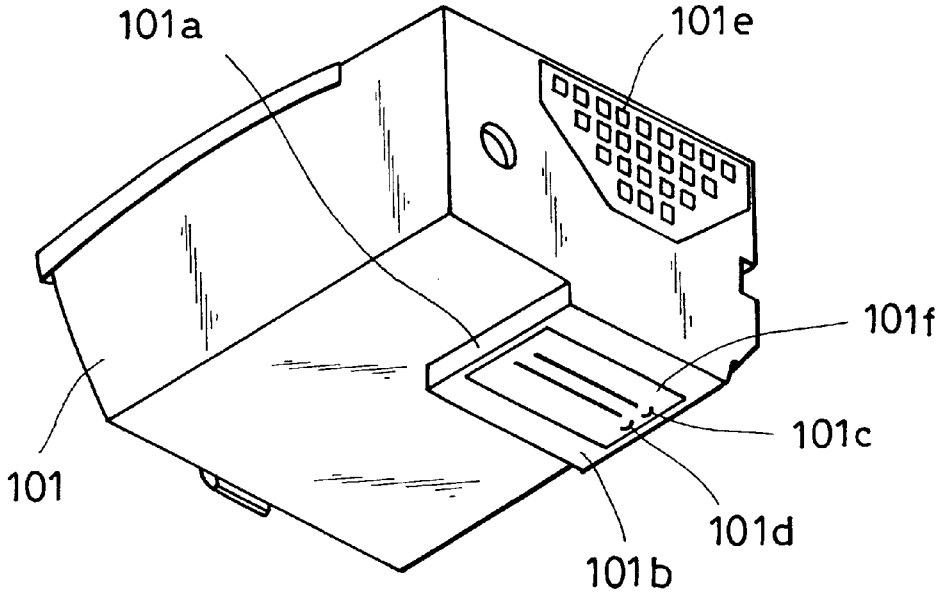
Figure 11:
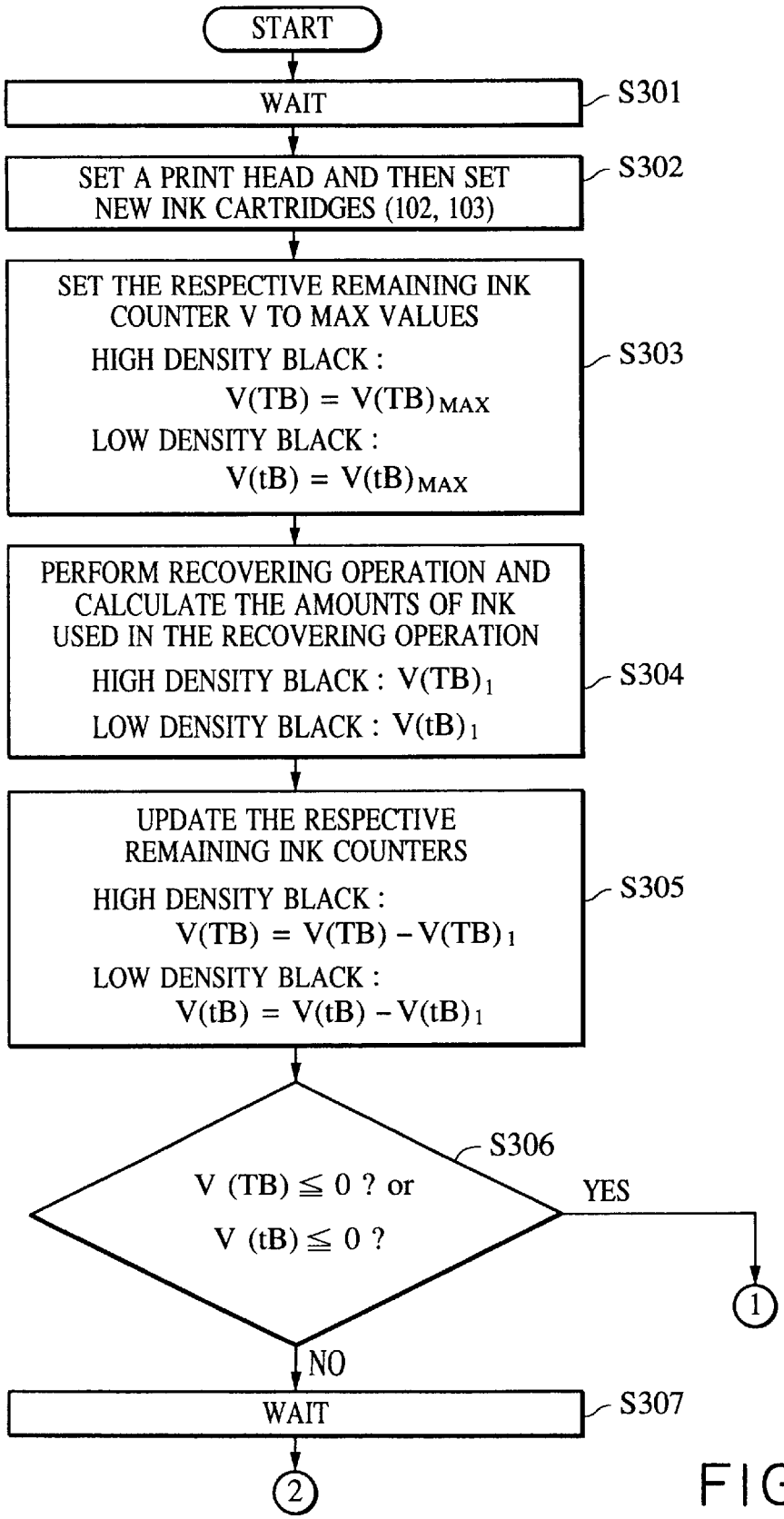
FIGS. 11–14 are flow charts illustrating the procedure of replacing ink cartridges according to the second embodiment of the invention.
Figure 12:
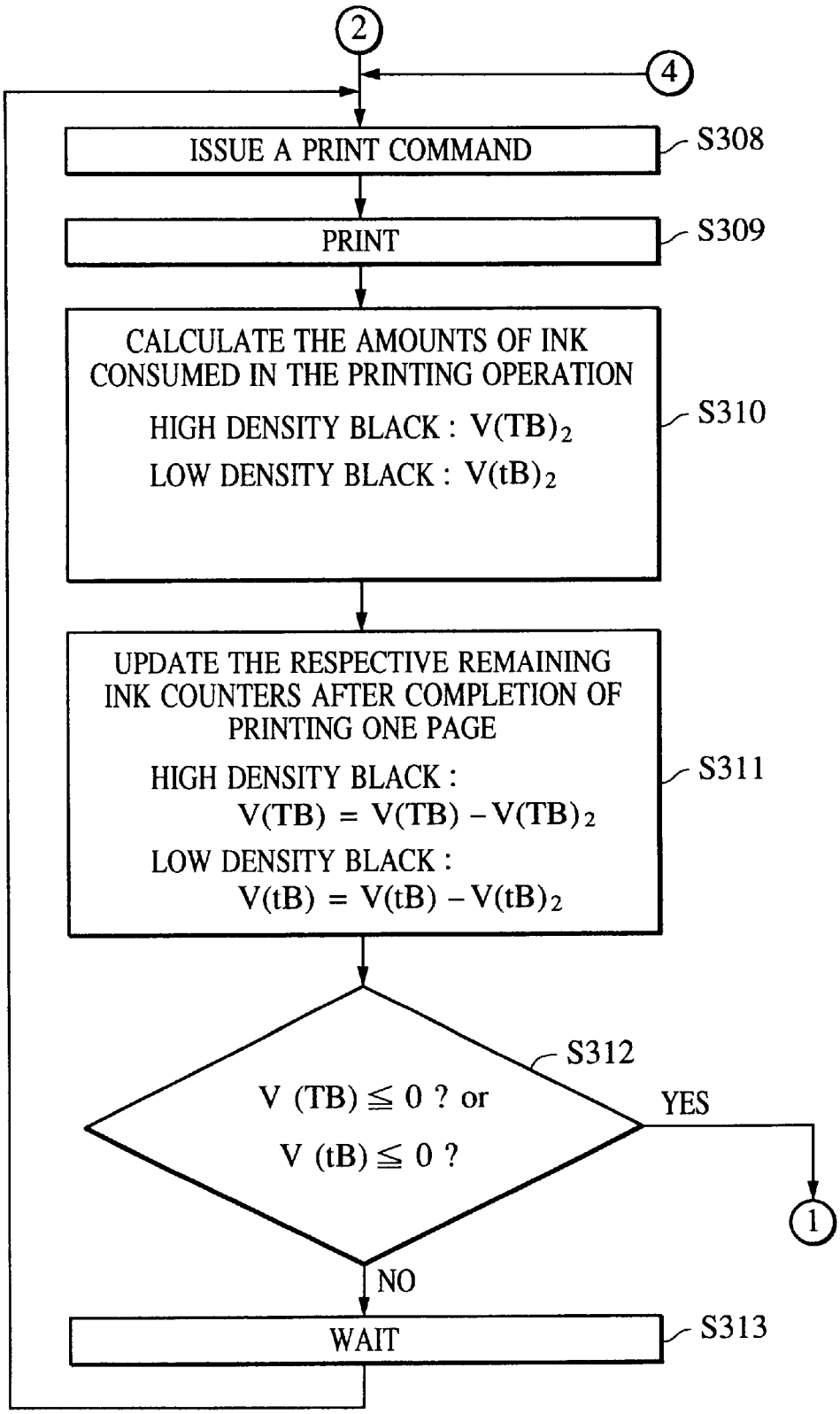

In this second embodiment, the procedure of replacing ink cartridges is described for the case where the ink cartridges are mounted on the recording head cartridge shown in FIGS. 9 and 10 provided in the recording apparatus 3 described in the first embodiment. In this second embodiment, the recording apparatus is constituted in the same manner as that according to the first embodiment except for the recording head cartridge, and thus it is not described in further detail herein.

The structure of the recording head cartridge 101 according to the present embodiment is described in detail with reference to FIGS. 9 and 10. FIG. 9 is a perspective view of the recording head cartridge 101 seen from above.

On the recording head cartridge 101, a high-density black ink cartridge 102 storing relatively high-density black ink and a low-density black ink cartridge 103 storing relatively low-density black ink are mounted in a removable fashion and such that the respective inks are supplied to the recording head cartridges 101.

This recording head cartridge 101 is capable of recording both high-density dots and low-density dots.

FIG. 10 is a perspective view illustrating the detailed structure of the recording head cartridge 101 seen from below.

In FIG. 10, reference numeral 101*a* denotes a recording head having an ink emission part 101*f* formed on the side 101*b* facing the recording sheet 5. Two linear arrays of nozzles 101*c* and 101*d* are formed on the ink emission part 101*f* in such a manner that the two linear arrays are located close to each other and extend in parallel. In this embodiment, the cap 24 shown in FIG. 2 is adapted to come into contact with the ink emission part 101*f* so as to protect the nozzle arrays 101*c* and 101*d*. In the recording head cartridge 101 shown in FIG. 10, the nozzle array 101*c* is used to emit the black ink (high-density black ink) supplied from the high-density black ink cartridge 102, and the nozzle array 101*d* is used to emit the black ink (low-density black ink) supplied from the low-density black ink cartridge 103. In FIG. 10, reference numeral 101*e* denotes a plate (on which electrode pads are formed) via which the electrical connection to the flexible circuit film 14 shown in FIG. 2 is achieved.

In the present embodiment, the break-even point is determined for the case where a plurality of ink cartridges are replaced at the same time and for the case where ink cartridges are replaced at different times, on the assumption that the standard document is recorded on the recording medium. On the basis of the determined break-even point, it is determined whether a plurality of ink cartridges should be replaced at the same time or at different times.

Herein, the recording of the standard document refers to the operation of recording a textual or graphical image in which all inks are consumed at the same ratio relative to the maximum ink capacity of the respective ink cartridges. The inks are all equal in cost as long as the ratios of the amounts of consumed inks relative to the maximum ink capacity are equal.

In this second embodiment, the amount of ink consumed in the recovering operation is denoted for each ink cartridge as follows:

High-density ink cartridge: $V(TB)_1$

Low-density ink cartridge $V(tB)_1$

Furthermore, the cost of ink per unit amount is denoted as follows:

High-density ink cartridge: $T(TB)_1$

Low-density ink cartridge $T(tB)_1$

Under the above conditions, if the amount of low-density black ink which still remains when the remaining amount of high-density black ink becomes zero is denoted by X, the break-even point in terms of cost for the case where both ink cartridges are replaced at the same time and for the case where they are replaced at different times can be determined as follows.

The cost needed when both ink cartridges are replaced at the same time is given by:

$$T(TB)_1 \cdot V(TB)_1 + T(tB)_1 \cdot (V(tB)_1 + X)$$

The cost needed when two ink cartridges are replaced separately is given by:

$$2\cdot(T(TB)_1\cdot V(TB)_1+T(tB)_1\cdot V(tB)_1)$$

The cost to replace both ink cartridges at the same time is lower than the cost to separately replace the ink cartridges when the following condition is satisfied:

$$T(TB)_1\cdot V(TB)_1+T(tB)_1\cdot(V(tB)_1+X)\leqq 2\cdot(T(TB)_1\cdot V(TB)_1+T(tB)_1\cdot V(tB)_1)$$

Thus $$X\leqq(T(TB)_1/T(tB)_1)\cdot V(TB)_1+V(tB)_1$$

Therefore, the break-even point is given by $$X=(T(TB)_1/T(tB)_1)\cdot V(TB)_1+V(tB)_1$$

The procedure of replacing the ink cartridge according to the present embodiment is now described below with reference to the flow charts shown in FIGS. 11 to 14.

After turning on the electric power of a new recording apparatus (step S301), a recording head cartridge 101 is set on a carriage 6. Furthermore, a new high-density black ink cartridge 102 and low-density black ink cartridge 103 are set on the recording head cartridge 101 (step S302). The count numbers of the remaining-ink counters V(Tk) and V(tB) of the high- and low-density black inks are each set to the maximum values (step S303). The maximum values are selected to be less than the lowest value of the variation in the amount of ink fully filled in each ink cartridge so that if the count values of the remaining-ink counters V(TB) and V(tB) are greater than zero, the actual amounts of ink never become zero.

A recovering operation is performed to get the recording head 101*a* recovered into a normal state. The amount of ink consumed by suction and preliminary emission in the recovering operation is calculated for each ink on the basis of the evacuating capacity of the pump 25, the amount of each droplet of ink, and the number of droplets emitted. The amounts of ink consumed in the recovering operation are set into the variables $V(TB)_1$ and $V(tB)_1$, respectively (step S304).

Figure 13:
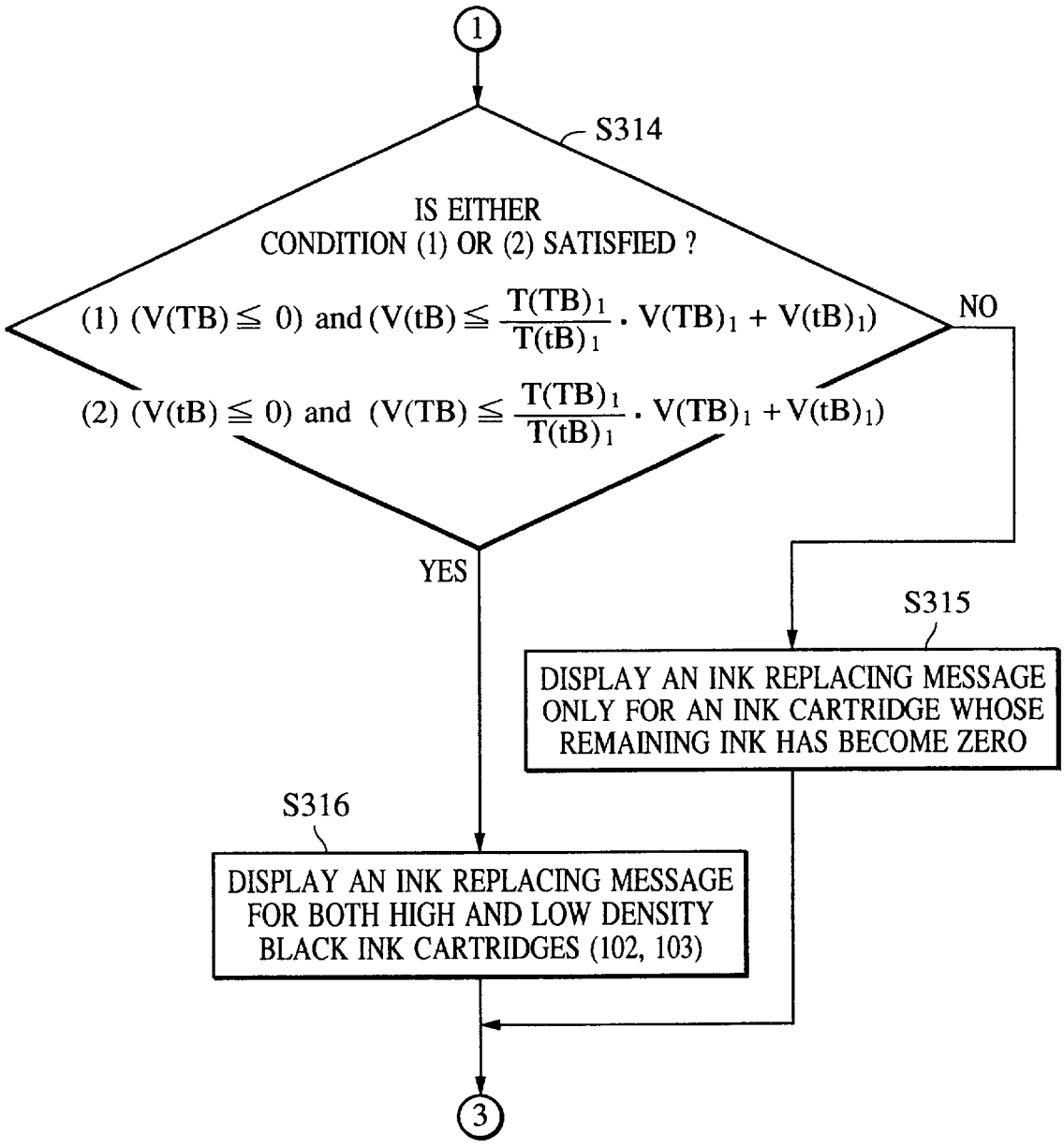
Figure 14:
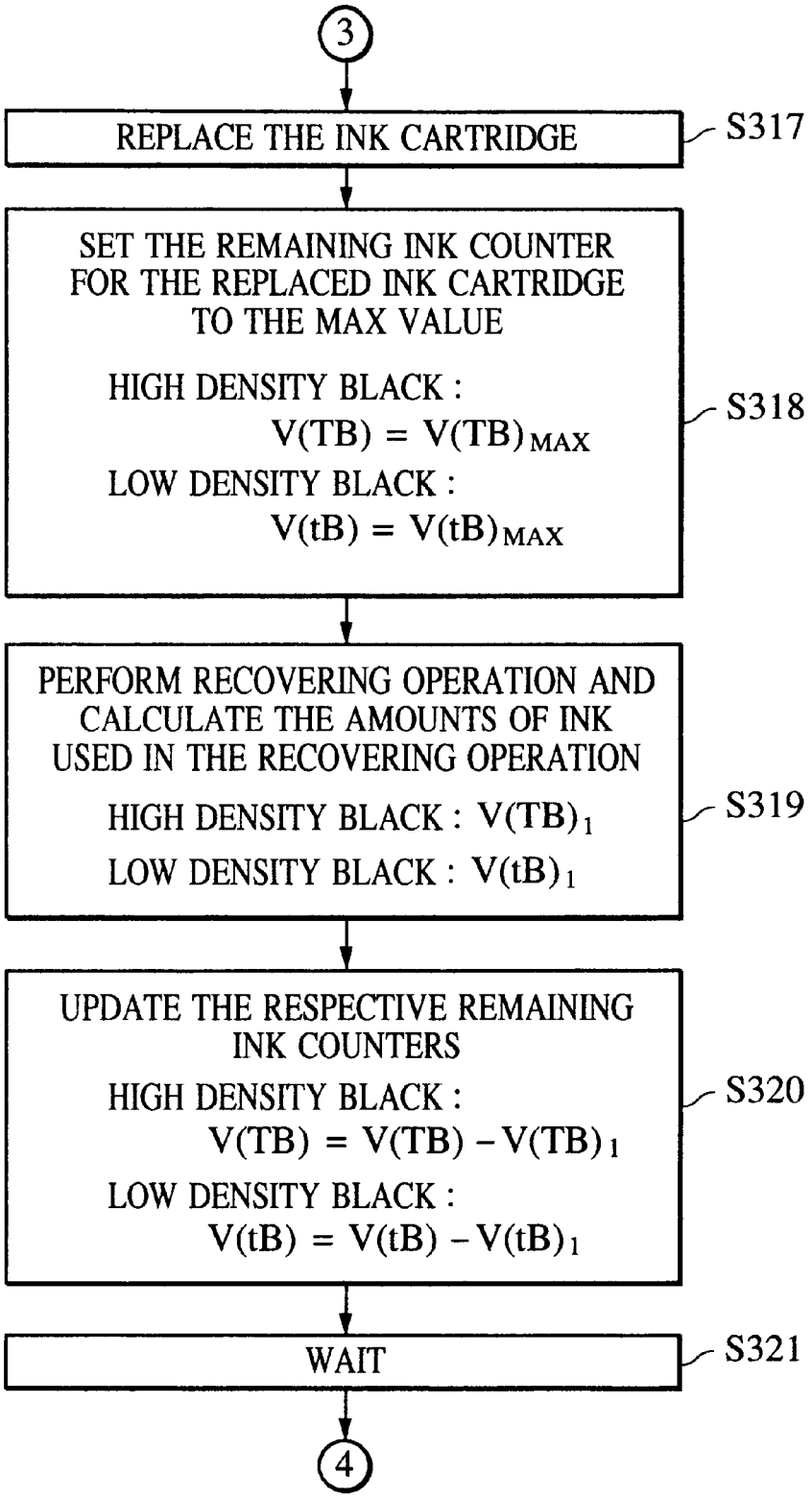
Figure 15:
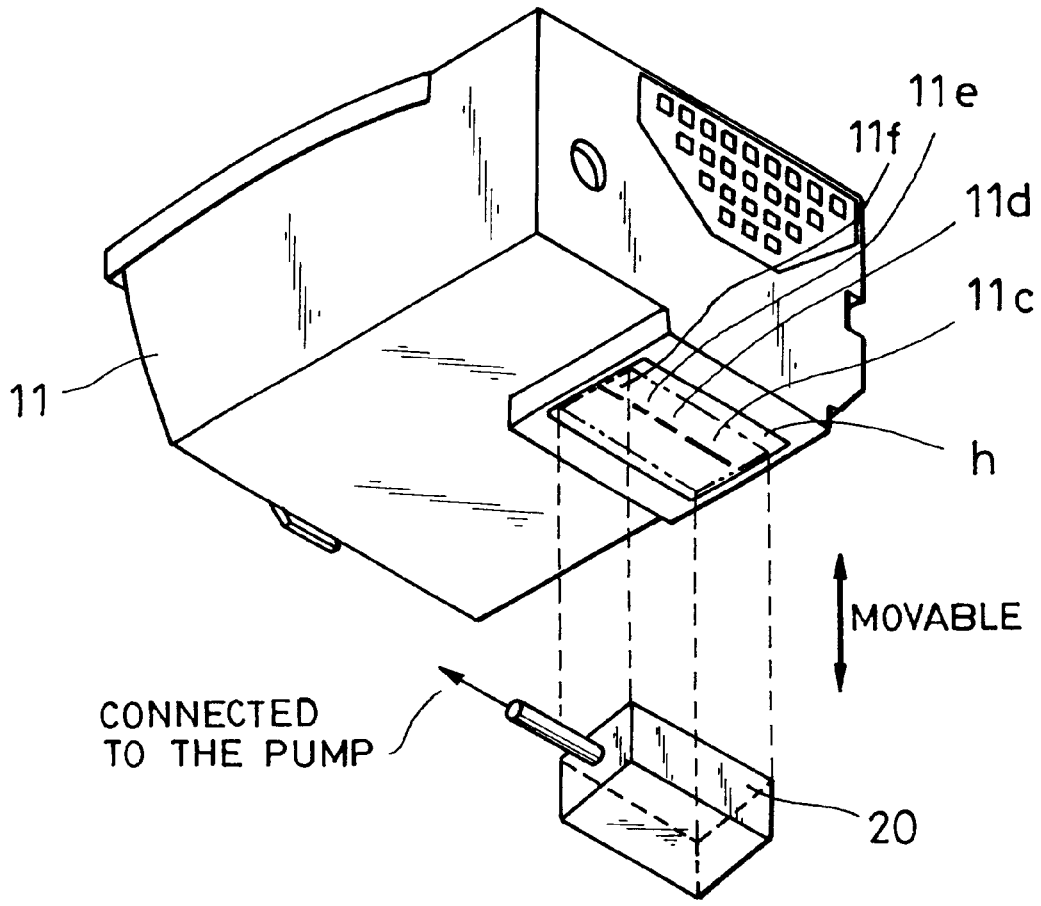
FIG. 15 is a schematic diagram illustrating a recording head cartridge and a cap for use in a recording apparatus according to a conventional technique.
Figure 16:
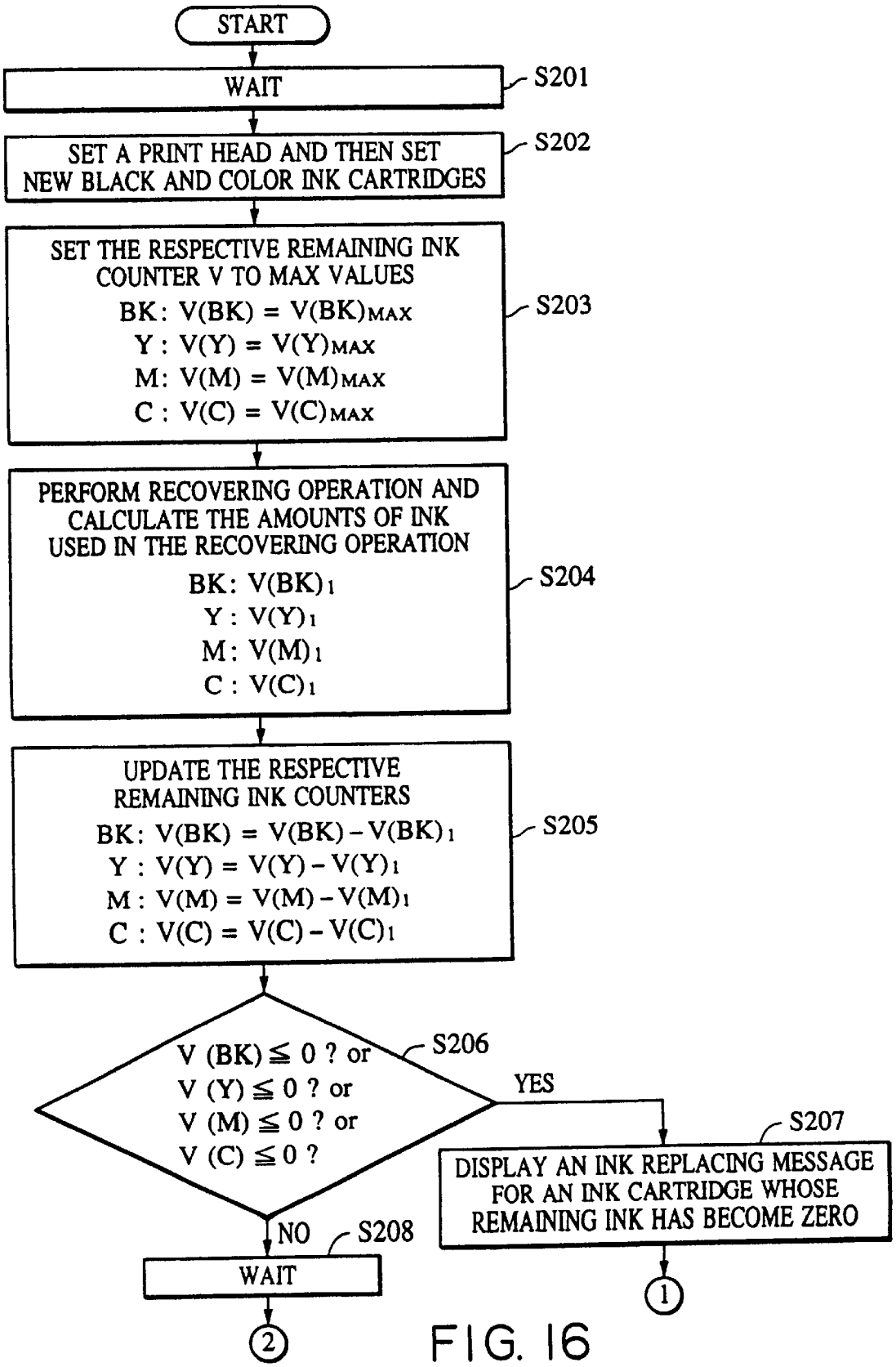
FIG. 16 PRIOR ART
FIGS. 16–18 are flow charts illustrating the procedure of replacing ink cartridges according to a conventional technique.
Figure 17:
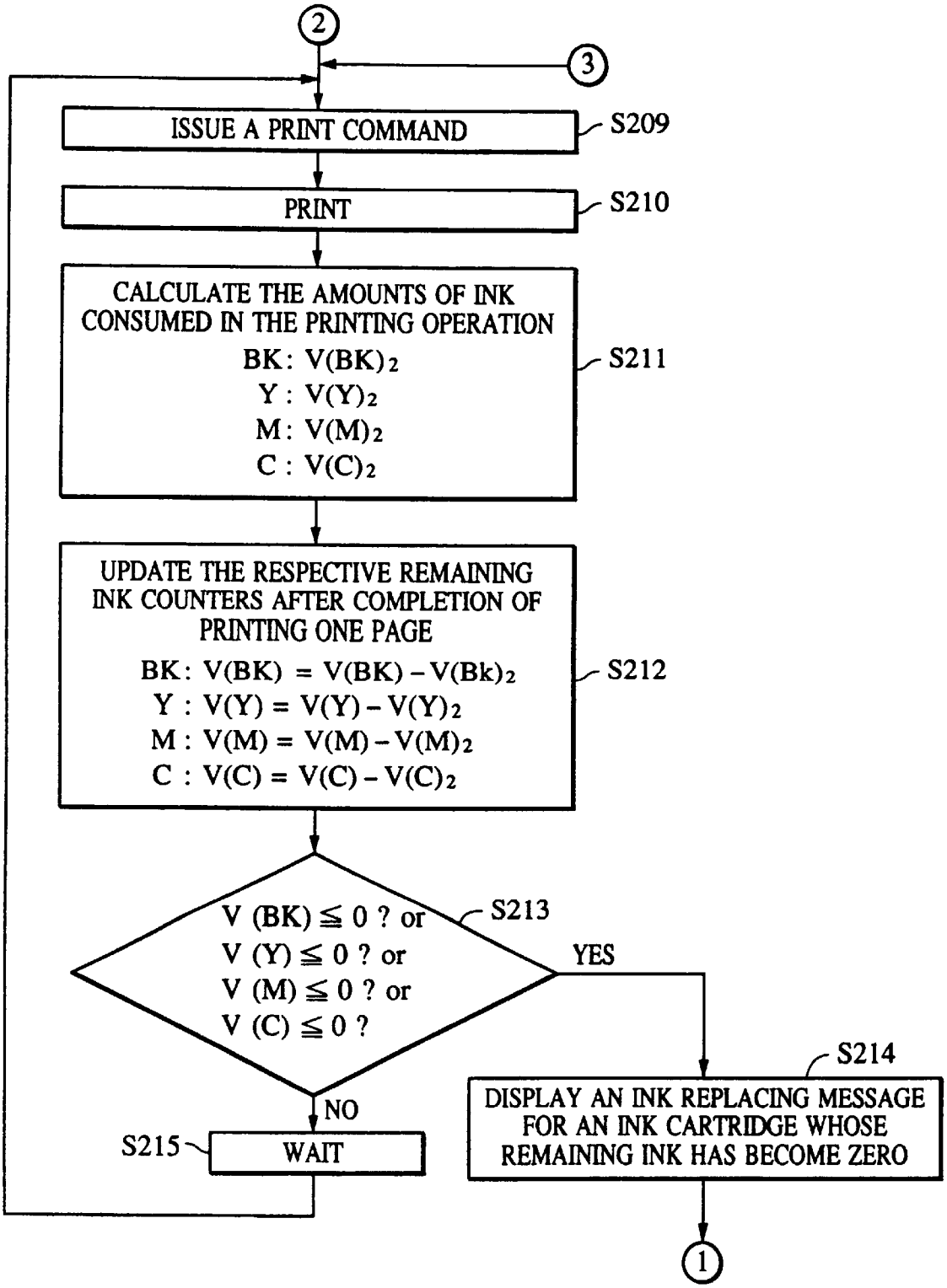
FIG. 17 PRIOR ART
Figure 18:
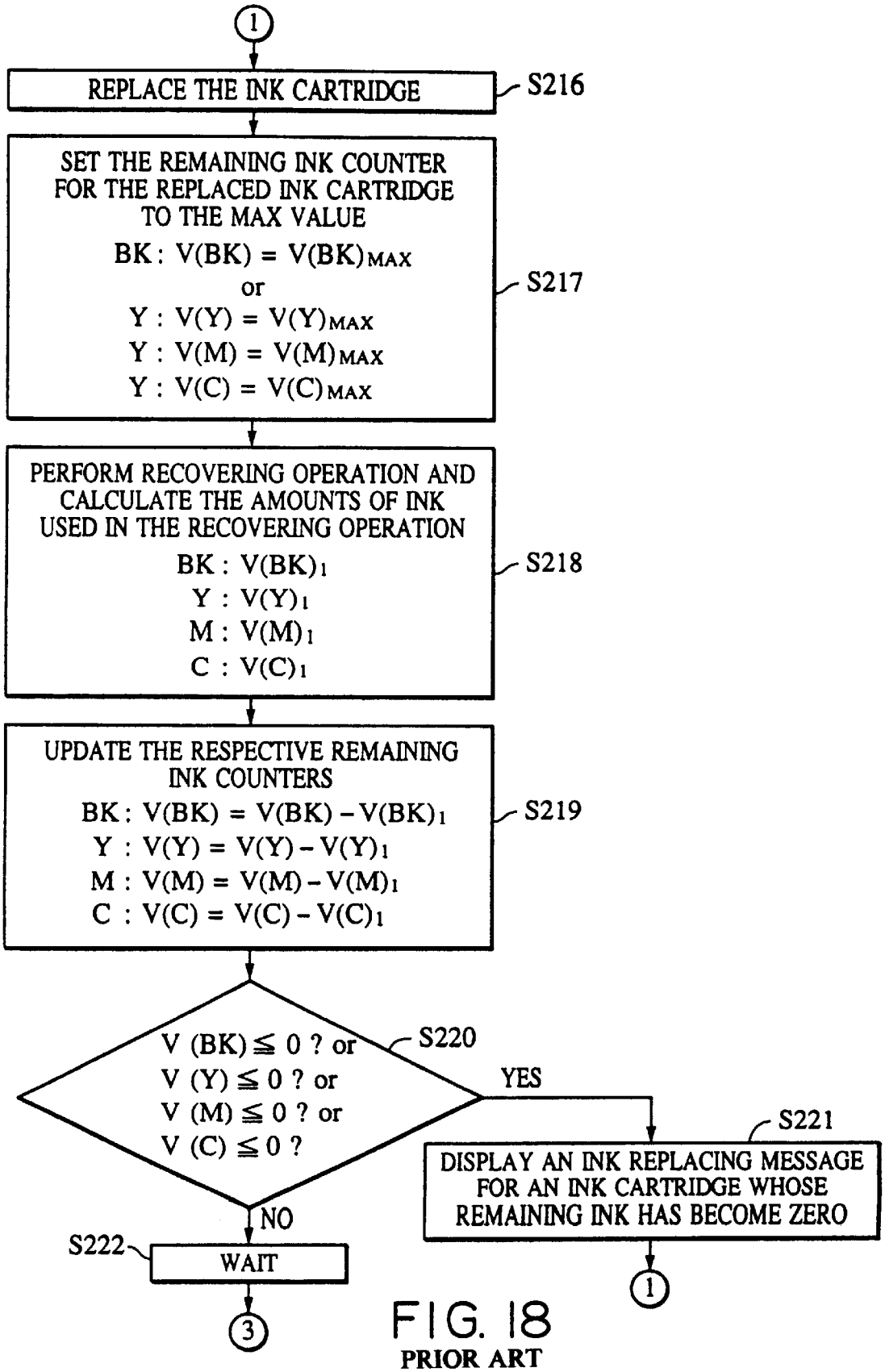
FIG. 18 PRIOR ART

The count values of the remaining-ink counters V(TB) and V(tB)are updated by subtracting the consumed amounts from the current count values of the remaining-ink counters (step S305). The count values of the remaining-ink counters V(TB) and V(tB) of the respective inks are checked whether they are equal to or less than zero (step S306). If the count value of any of the remaining-ink counters of the high- or low-density black ink is detected to be equal to or less than zero, then the process goes to step S314 (FIG. 13). On the other hand, if it is determined that the count values of the remaining-ink counters V(TB) and V(tB) of the high- and low-density black inks are both greater than zero, then the process goes into a waiting state and waits for a recording command (step S307).

If a recording command is received (step S308), then recording is performed on one page of recording sheet (step S309) and the amount of ink consumed in the recording operation is calculated for each ink. Herein the calculation can be accomplished on the basis of the amount of one droplet of ink and the number of droplets of each ink used in the recording operation. The amounts of inks consumed in the recording operation are substituted into the variables $V(TB)_2$ and $V(tB)_2$, respectively (step S310).

After completion of the recording operation on one page of recoding sheet, the count values of the remaining-ink counters V(TB) and V(tB) are updated by subtracting the consumed amounts from the current count values of the respective remaining-ink counters (step S311). The count values of the remaining-ink counters V(TB) and V(tB) of the respective inks are checked whether they are equal to or less than zero (step S312). If the count value of any of the remaining-ink counters V(TB) or V(tB) associated with the high- or low-density black ink is equal to or less than zero, then the process goes to step S314. On the other hand, if it is determined that the count values of the remaining-ink counters V(TB) and V(tB) associated with the high- and low-density black inks are both greater than zero, then the process goes into a waiting state and waits for a recording command (step S313).

In step S306 or S312, if the count value of any remaining-ink counter V(TB) or V(tB) associated with the high- or low-density black ink is equal to or less than zero, then the process goes to step S314. In step S314 (FIG. 13), the count value of the remaining-ink counter V(TB) or V(tB)having a value greater than zero is compared with the amount of ink corresponding to the break-even point.

If the count value of the remaining-ink counter is greater than the amount of ink corresponding to the break-even point, a message is displayed on a display 2 to tell that only the ink cartridge with no remaining ink should be replaced. For example, if the high-density black ink becomes zero in the remaining amount, a message such as "High-density black ink has run out. Please replace it." is displayed on the display 2 (step S315).

However, if the count value of the remaining-ink counter is smaller than the amount of ink corresponding to the break-even point, a message is displayed on the display 2 to tell that both ink cartridges should be replaced (step S316). The operation of replacing the ink cartridge is described below with reference to FIG. 14. After the ink cartridge was replaced in accordance with the message in step S317, the count value of the remaining-ink counter associated with the replaced ink cartridge is reset to the maximum value (step S318). The recovering operation is then performed to get the ink flowing path associated with the replaced ink cartridge recovered into a normal state, and the amount of ink consumed in the recovering operation is calculated (step S319). The count values of the remaining-ink counters V(TB) and V(tB) are updated by subtracting the amounts of ink consumed in the recovering operation from the current count values of the remaining-ink counters (step S320).

In this particular case, since the count values of the remaining-ink counters V(TB) and V(tB) are both greater than zero, the process goes into a waiting state and waits for a recording command (step S321).

In the present embodiment, as described above, on the basis of the cost per unit amount of ink stored in each of the plurality of ink cartridges, the break-even point in terms of cost is calculated for the case where only the ink cartridge having no remaining ink is replaced and for the case where another ink cartridge is also replaced at the same time, thereby determining the optimum manner in which ink cartridges are replaced. That is, it is determined whether only the ink cartridge whose remaining amount of ink has become low is replaced or another ink cartridge in addition to that is also replaced, on the basis of the cost needed for the replacement. This makes it possible to replace the ink cartridges with the minimized cost. If the technique according to the present embodiment is employed, it is possible to properly replace ink cartridges even in the case where the cost varies depending on the type of ink contained in the respective ink cartridges.

The present invention is not limited to the above-described conditions in terms of the type of the document to be recorded, the cost of inks, etc. The present invention may also be applied to other conditions where the recording apparatus is used.

Furthermore, the invention is not limited to the recording apparatus having the recording cartridge of the type described in the first or second embodiment. For example, the invention may be applied to a recording apparatus having ink cartridges and recording heads for emitting ink supplied from ink cartridges wherein the recovering operation is performed at the same time on the plurality of recording heads adapted to emit inks supplied from the plurality of ink cartridges instead of separately performing the recovering operation on the respective recording heads.

In the first embodiment described above, black ink is stored in a single ink cartridge and other color inks (Y, M, C) are stored in another single cartridge. However, the present invention may also be applied to a combination if ink cartridges in which each color ink is stored in its own separate cartridge. Furthermore, the technique disclosed in the first embodiment may also be applied to the recording apparatus according to the second embodiment which uses high- and low-density inks or which uses any different types of inks. Conversely, the technique disclosed ion the second embodiment may be applied to the recording apparatus using a black ink and a plurality of color inks.

Furthermore, the invention is not limited to inks containing pigments used in the recording operation but may also be applied to auxiliary agents which react with the ink on the recording sheet and improves the fastness of the recorded image.

In the embodiments described above, the ink cartridges are removable from the recording head. However, the present invention may also be applied to the structure in which the recording head and the ink cartridges are formed in a single piece. Still furthermore, the invention may also be applied to the structure in which the recording head and the ink cartridges are formed in a single piece and there is provided ink supply members through which ink can be supplied to the cartridges using for example a dropping pipette.

Furthermore, in the embodiments described above, the invention is applied to the serial type recording apparatus. However, the invention may also be applied to a full line type recording apparatus provided with a full line head capable of recording over the entire length of the width of a recording sheet.

Although in the embodiments described above the invention is applied to a word processor provided with a recording apparatus of the type shown in FIG. 1, the invention is not limited to the word processor, but may also be applied to various types of recording apparatus. For example, the invention may be applied to an ink-jet recording apparatus used in a printer connected to a computer so as to output an image, a facsimile machine for transmitting and receiving information via a telephone line, and a copying machine for scanning an image and outputting it.

Still furthermore, in the embodiments described above, the means for detecting the amount of remaining ink calculates the amount of remaining ink on the basis of the amount of ink consumed in various operations starting at the time when an ink cartridge is replaced. However, the present invention may also be applied to means which detects the amount of remaining ink based on various techniques.

Still furthermore, in the embodiments described above, a display is employed as informing means. However, the invention may also be applied to informing means based on other techniques such as a device adapted to present information to a user by changing the number of frequency of a sound or light using a buzzer or a lamp. An LED may be employed as a means for emitting light.

In these examples, excellent effects can be obtained particularly in a recording head and a recording apparatus of a system in which a means (for example, an electro-thermal converting element, laser beam, etc.) for generating thermal energy as energy used in discharging an ink is equipped, and the change of state of the ink is caused to take place by the thermal energy, among the ink-jet recording systems. According to such a system, recording high in density and resolution can be achieved.

With respect to its typical structure and principle, it is preferred to employ the basic-principle disclosed in, for example, U.S. Pat. Nos. 4,723,129 and 4,740,796. This system can be applied to both so-called "On-Demand" type and "Continuous" type structures. This system is advantageous to the On-Demand type in particular because an electro-thermal converting element disposed to align to a sheet or a liquid passage in which a liquid (ink) is held is applied with at least one drive signal which corresponds to information to be recorded and which enables the temperature of the electro-thermal converting element to be rapidly raised higher than a nucleate boiling point, so that thermal energy is generated in the electro-thermal converting element and film boiling is caused to take place on the surface of the recording head which is heated. As a result, bubbles can be respectively formed in the liquid (ink) in response to the drive signals. Owing to the enlargement and contraction of the bubbles, the liquid (ink) is discharged through the discharging orifice, so that at least one droplet is formed. In a case where the aforesaid drive signal is made to be a pulse signal, a further satisfactory effect can be obtained in that the bubbles can immediately and properly be enlarged/contracted and the liquid (ink) can be discharged while exhibiting excellent responsibility.

It is preferable to use a drive signal of the pulse signal type disclosed in U.S. Pat. Nos. 4,463,359 and 4,345,262. Furthermore, in a case where conditions for determining the temperature rise ratio on the aforesaid heating surface disclosed in U.S. Pat. No. 4,313,124 are adopted, a further excellent recording operation can be performed.

In addition to the structure (a linear liquid passage or a perpendicular liquid passage) of the recording head formed by combining the discharging orifice, the liquid passage and the electro-thermal converting element as disclosed in the aforesaid specifications, a structure disclosed in U.S. Pat. Nos. 4,558,333 and 4,459,600 in which the heated portion is disposed in a bent portion is included in the scope of the present invention.

Furthermore, the present invention can effectively be embodied in a structure in which a common slit is made to be the discharge portion of a plurality of electro-thermal converting elements and which is disclosed in Japanese Patent Laid-Open No. 59-123670 and a structure in which an opening for absorbing thermal energy pressure waves is defined to align to the discharge part and which is disclosed in Japanese Patent Laid-Open No. 59-138461. Namely, according to the present invention, recording operation can be performed surely and effectively irrespective of the form of the recording head.

The present invention may be applied to a full line type recording head having a length which corresponds to the maximum width of the recording medium, which can be recorded by the recording apparatus.

Such a recording head may be either a structure capable of realizing the aforesaid length and formed by combining a plurality of recording heads or a structure formed by an integrally formed recording head. In addition, the present invention can also be effectively applied to a recording head fixed to the body of the apparatus, a structure having an interchangeable chip type recording head which can be electrically connected to the body of the apparatus or to which an ink can be supplied from the body of the apparatus when it is mounted on the body of the apparatus, or a cartridge type recording head provided with an ink tank integrally formed to the recording head itself among the above-exemplified serial type recording heads.

It is preferable to additionally provide a recording head recovery means and an auxiliary means of the recording apparatus according to the present invention because the effects of the present invention can further be stabilized. Specifically, an effect can be obtained in that the recording operation can be stably performed by providing a recording head capping means, a cleaning means, a pressurizing or sucking means, an electro-thermal converting element or another heating device or an auxiliary heating means formed by combining the aforesaid elements and by performing a preliminary discharge mode in which a discharge is performed individually from the recording operation.

Although the embodiments of this invention, which have been described above, used the liquid inks, inks which are solid at a temperature lower than room temperature, but are softened or liquefied at room temperature may be used. In the aforesaid ink-jet system, the temperature of an ink is usually controlled in a range from 30° C. to 70° C. so as to adjust the viscosity of the ink within a stable discharge range. Therefore, it is only necessary to use inks which are liquefied in response to a record signal applied. Furthermore, inks, the temperature rise of which is prevented by positively using the temperature rise due to the thermal energy as energy of state change from the solid state to the liquid state of ink or inks which are solidified when it is allowed to stand in order to prevent the evaporation of ink may be used. That is, inks which are liquefied by thermal energy for the first time such as inks liquefied by thermal energy applied in response to the record signal and discharged as ink droplets or inks which already begin to solidify when they reach the recording medium may be employed in the present invention. In this case, an ink may be, in the form of liquid or solid, held by a recess of a porous sheet or a through hole as disclosed in Japanese Patent Laid-Open No. 54-56847 or 60-71260 and disposed to confront the electro-thermal converting element. It is most preferable for the above-described inks that an ink be discharged by the aforesaid film boiling method.

Furthermore, the ink-jet recording apparatus according to this invention may be in the form, in addition to that used as an image-output terminal for information processing equipment such as a computer, of a copying machine combined with a reader and moreover, of a facsimile terminal equipment having a transmit-receive function or the like.

Still furthermore, the present invention may be applied either to a system including a plurality of devices (such as a host computer, interface device, reader, printer, etc.) or to an apparatus constructed in a single form (such as a copying machine, facsimile machine, etc.).

Furthermore, the objects of the present invention may also be achieved by supplying a storage medium, on which a software program implementing the functions of any of the embodiments described above is stored, to a system or an apparatus whereby a computer (CPU or MPU) in the system or apparatus reads and executes the program code stored on the storage medium.

In this case, it should be understood that the program code read from the storage medium implements the functions of the invention and thus the storage medium storing the program code falls within the scope of present invention.

Storage media which can be preferably employed in the present invention to supply the program code include a floppy disk, hard disk, optical disk, magneto-optical disk, CD-ROM, CD-R, magnetic tape, non-volatile memory card, and ROM.

Furthermore, the scope of the present invention includes not only such a system in which the functions of any embodiment described above is implemented simply by reading and executing a program code on a computer but also a system in which a part of or the whole of process instructed by the program code is performed using an OS (operating system) on the computer.

As described above, the present invention provides a recording apparatus and a method of controlling the operation of the recording apparatus in which the timing of replacing or refilling the ink storage means which supplies ink to a recording head so that the operation of recovering the recoding head is performed in a highly efficient manner thus minimizing the amount of ink and the time consumed in an useless manner.

What is claimed is:

1. A recording apparatus for performing a recording operation using a recording head for emitting ink, said recording apparatus comprising:

a mounting unit for replaceably mounting a plurality of ink storage means for storing ink supplied to said recoding head;

remaining amount detection means for detecting the amount of ink remaining in each of the plurality of ink storage means; and judgement means for determining whether it is required to replace some of the plurality of ink storage means on the basis of the detection result given by said remaining detection means, wherein said judgement means determines whether the amount of ink remaining in some of the plurality of ink storage means has decreased to such an extent that the ink storage means has to be replaced, and if it is determined that there is ink storage means which should be replaced, said judgement means determines that another ink storage means whose remaining ink is lower than a predetermined value should also be replaced; and informing means for presenting information about the ink storage means which should be replaced, in accordance with the judgement result given by said judgement means.

2. A recording apparatus according to claim 1, further comprising:

recovery means for recovering the emission conditions of said recording head by means of discharging ink from said recording head; and recover control means for controlling said recovery means so that said recovery means performs the recovering operation after ink storage means is replaced, wherein said predetermined value is determined depending on the amount of ink discharged from said recording head during the recovering operation performed after the ink storage means is replaced.

3. A recording apparatus according to claim 2, wherein said recovery means recovers the emission conditions of the recording head by emitting ink from the recording head.

4. A recording apparatus according to claim 2, wherein said recovery means recovers the emission conditions of the recording head by discharging ink from the recording head by means of sucking.

5. A recording apparatus according to claim 2, wherein said recovery means consumes ink of all said plurality of ink storage means during the recovering operation.

6. A recording apparatus according to claim 1, wherein said predetermined value is determined on the basis of the break-even point in terms of cost determined for the case where only the ink storage means, whose amount of ink remaining therein has decreased to such an extent that the ink storage means has to be replaced, is replaced and also for the case where in addition to such ink storage means ink storage means whose amount of ink remaining therein has decreased to a level lower than said predetermined value is also replaced.

7. A recording apparatus according to claim 6, wherein said break-even point in terms of cost is determined on the basis of the cost per unit amount of ink stored in each said plurality of ink storage means.

8. A recording apparatus according to claim 1, wherein:

said judgement means determines that ink storage means should be replaced if the amount of ink remaining in said ink storage means has become lower than a first predetermined value;

if said judgement means determines that there is ink storage means which should be replaced, then said judgement means further determines that ink storage means whose amount of ink remaining therein is smaller than a second predetermined value greater than said first predetermined value should also be replaced.

9. A recording apparatus according to claim 8, further comprising:

recovery means for recovering the emission conditions of said recording head by means of discharging ink from said recording head; and recover control means for controlling said recovery means so that said recovery means performs the recovering operation after ink storage means is replaced, wherein said second predetermined value is determined on the basis of the amount of ink discharged from the recording head during the recovering operation performed after the replacement of the ink storage means.

10. A recording apparatus according to claim 9, wherein said recovery means recovers the emission conditions of the recording head by emitting ink from the recording head.

11. A recording apparatus according to claim 9, wherein said recovery means recovers the emission conditions of the recording head by discharging ink from the recording head by means of sucking.

12. A recording apparatus according to claim 9, wherein said recovery means consumes ink of all said plurality of ink storage means during the recovering operation.

13. A recording apparatus according to claim 8, wherein said second predetermined value is determined on the basis of the break-even point in terms of cost determined for the case where only the ink storage means whose amount of ink remaining therein has become lower than said first predetermined value is replaced and also for the case where in addition to such ink storage means ink storage means whose amount of ink remaining therein has become lower than said second predetermined value is also replaced.

14. A recording apparatus according to claim 13, wherein said break-even point in terms of cost is determined on the basis of the cost per unit amount of ink stored in each said plurality of ink storage means.

15. A recording apparatus according to claim 1, wherein said plurality of ink storage means are ink cartridges which are capable of supplying ink when they are mounted on said mounting unit.

16. A recording apparatus according to claim 1, wherein said plurality of ink storage means are integrated in a single form with said recording head.

17. A recording apparatus according to claim 1, wherein said recording head includes an emission orifice via which ink is emitted and also includes emission means for emitting ink via said emission orifice.

18. A recording apparatus according to claim 17, wherein said emission means is an electro-thermal conversion element for applying thermal energy to ink so that a bubble is generated in said ink by the thermal energy thereby emitting the ink via said emission orifice.

19. A method of controlling a recording apparatus, said recording apparatus including a mounting unit for replaceably mounting a plurality of ink storage means for storing ink, said recording apparatus being adapted to perform a recording operation using a recording head for emitting ink supplied from said ink storage means, said method comprising the steps of:

detecting the amount of ink remaining in each of the plurality of ink storage means;

judging whether replacement is required on each of the plurality of ink storage means on the basis of the detection result obtained in the step of detecting the amount of remaining ink, wherein in said judgement step it is determined whether the amount of ink remaining in some of the plurality of ink storage means has decreased to such an extent that the ink storage means has to be replaced, and if it is determined that there is ink storage means which should be replaced, it is further determined that another ink storage means whose remaining ink is lower than a predetermined value should also be replaced; and presenting information about the ink storage means which should be replaced, in accordance with the judgement result made in said judgement step.

20. A method for controlling a recording apparatus, according to claim 19, wherein said judgement step determines that ink storage means should be replaced if the amount of ink remaining in ink storage means has become lower than a first predetermined value; and if it is determined that there is ink storage means which should be replaced, then it is further determined that ink storage means whose amount of ink remaining therein is smaller than a second predetermined value greater than said first predetermined value should also be replaced.

21. A method for controlling a recording apparatus, according to claim 20, further comprising the steps of:

after completion of replacing said ink storage means, recovering the emission conditions of said recording head by discharging ink from said recording head, wherein said second predetermined value is determined on the basis of the amount of ink discharged from the recording head during said recovering step performed after the replacement of the ink storage means.

22. A method for controlling a recording apparatus, according to claim 21, wherein in said recovering step, the emission conditions of the recording head are recovered by emitting ink from the recording head.

23. A method for controlling a recording apparatus, according to claim 21, wherein in said recovering step, the emission conditions of the recording head are recovered by discharging ink from the recording head by means of sucking.

24. A method for controlling a recording apparatus, according to claim 21, wherein in said recovering step, ink of all said plurality of ink storage means is consumed by the recovering operation.

25. A method for controlling a recording apparatus, according to claim 20, wherein said second predetermined value is determined on the basis of the break-even point in terms of cost determined for the case where only the ink storage means whose amount of ink remaining therein has become lower than said first predetermined value is replaced and also for the case where in addition to such ink storage means ink storage means whose amount of ink remaining therein has become lower than said second predetermined value is also replaced.

26. A method for controlling a recording apparatus, according to claim 25, wherein said break-even point in terms of cost is determined on the basis of the cost per unit amount of ink stored in each said plurality of ink storage means.

27. A method for controlling a recording apparatus, according to claim 19, wherein said recording head includes an emission orifice via which ink is emitted and also includes emission means for emitting ink via said emission orifice.

28. A method for controlling a recording apparatus, according to claim 27, wherein said emission means is an electro-thermal conversion element for applying thermal energy to ink so that a bubble is generated in said ink by the thermal energy thereby emitting the ink via said emission orifice.

29. A recording apparatus for performing a recording operation using a recording head for emitting ink, said recording apparatus comprising:

a plurality of ink storage means for storing ink supplied to said recoding head;

remaining amount detection means for detecting the amount of ink remaining in each of the plurality of ink storage means; and judgement means for determining whether it is required to refill some of the plurality of ink storage means with ink on the basis of the detection result given by said remaining detection means, wherein said judgement means determines whether the amount of ink remaining in some of the plurality of ink storage means has decreased to such an extent that the ink storage means should be refilled with ink, and if it is determined that there is ink storage means which should be refilled with ink, said judgement means determines that another ink storage means whose remaining ink is lower than a predetermined value should also be refilled with ink; and informing means for presenting information about the ink storage means which should be refilled with ink, in accordance with the judgement result given by said judgement means.

30. A recording apparatus according to claim 29, wherein:

said judgement means determines that ink storage means should be refilled with ink if the amount of ink remaining in said ink storage means has become lower than a first predetermined value; and if said judgement means determines that there is ink storage means which should be refilled with ink, then said judgement means further determines that ink storage means whose amount of ink remaining therein is smaller than a second predetermined value greater than said first predetermined value should also be refilled with ink.

31. A recording apparatus according to claim 30, further comprising:

recovery means for recovering the emission conditions of said recording head by means of discharging ink from said recording head; and recover control means for controlling said recovery means so that said recovery means performs the recovering operation after ink storage means is refilled with ink;

wherein said second predetermined value is determined on the basis of the amount of ink discharged from the recording head during the recovering operation performed after the ink storage means is refilled with ink.

32. A recording apparatus according to claim 31, wherein said recovery means recovers the emission conditions of the recording head by emitting ink from the recording head.

33. A recording apparatus according to claim 31, wherein said recovery means recovers the emission conditions of the recording head by discharging ink from the recording head by means of sucking.

34. A recording apparatus according to claim 31, wherein said recovery means consumes ink of all said plurality of ink storage means during the recovering operation.

35. A recording apparatus according to claim 30, wherein said second predetermined value is determined on the basis of the break-even point in terms of cost determined for the case where only the ink storage means whose amount of ink remaining therein has become lower than said first predetermined value is refilled with ink and also for the case where in addition to such ink storage means ink storage means whose amount of ink remaining therein has become lower than said second predetermined value is also refilled with ink.

36. A recording apparatus according to claim 35, wherein said break-even point in terms of cost is determined on the basis of the cost per unit amount of ink stored in each said plurality of ink storage means.

37. A recording apparatus according to claim 29, wherein: said plurality of ink storage means are ink cartridges which can be refilled with ink.

38. A recording apparatus according to claim 29, wherein: said plurality of ink storage means are integrated in a single form with said recording head.

39. A recording apparatus according to claim 29, wherein: said recording head includes an emission orifice via which ink is emitted and also includes emission means for emitting ink via said emission orifice.

40. A recording apparatus according to claim 39, wherein: said emission means is an electro-thermal conversion element for applying thermal energy to ink so that a bubble is generated in said ink by the thermal energy thereby emitting the ink via said emission orifice.

41. A method of controlling a recording apparatus, said recording apparatus including a plurality of ink storage means for storing ink, said recording apparatus being adapted to perform a recording operation using a recording head for emitting ink supplied from said ink storage means, said method comprising the steps of:

detecting the amount of ink remaining in each of the plurality of ink storage means;

judging whether some of the plurality of ink storage means should be refilled with ink on the basis of the detection result obtained in the step of detecting the amount of remaining ink, wherein in said judgement step it is determined whether the amount of ink remaining in some of the plurality of ink storage means has decreased to such an extent that the ink storage means should be refilled with ink, and if it is determined that there is ink storage means which should be refilled with ink, said judgement means determines that another ink storage means whose remaining ink is lower than a predetermined value should also be refilled with ink; and presenting information about the ink storage means which should be refilled with ink, in accordance with the judgement result made in said judgement step.

42. A method for controlling a recording apparatus, according to claim 41, wherein said judgement step determines that ink storage means should be refilled with ink if the amount of ink remaining in ink storage means has become lower than a first predetermined value; and if it is determined that there is ink storage means which should be refilled with ink, then it is further determined that ink storage means whose amount of ink remaining therein is smaller than a second predetermined value greater than said first predetermined value should also be refilled with ink.

43. A method for controlling a recording apparatus, according to claim 42, further comprising the steps of:

after completion of refilling said ink storage means with ink, recovering the emission conditions of said recording head by discharging ink from said recording head, wherein said second predetermined value is determined on the basis of the amount of ink discharged from the recording head during said recovering step performed after the ink storage means is refilled with ink.

* * * * *

UNITED STATES PATENT AND TRADEMARK OFFICE

CERTIFICATE OF CORRECTION

PATENT NO. : 6,070,958

DATED : June 6, 2000

INVENTOR(S) : Yuji Kanome

It is certified that error appears in the above-identified patent and that said Letters Patent is hereby corrected as shown below:

IN THE ABSTRACT

Line 1, change "An" to --A--; and
line 20, change "runs out" to --runs out of--.

Column 1

Line 61, change "intended" to --the intended--.

Column 2

Line 12, change "recoding" to --recording--.

Column 3

Line 61, change "cartridge" to --cartridge 13--.

Column 4

Line 11, change "recoding" to --recording--.

Column 5

Line 39, change "cartridge" to --cartridges--; and
line 43, change "cartridge" to --cartridges--.

UNITED STATES PATENT AND TRADEMARK OFFICE

CERTIFICATE OF CORRECTION

PATENT NO. : 6,070,958

DATED : June 6, 2000

INVENTOR(S) : Yuji Kanome

It is certified that error appears in the above-identified patent and that said Letters Patent is hereby corrected as shown below:

Column 6

Line 30, change "take" to --taken--; and
line 52, change "recoding" to --recording--.

Column 7

Line 18, change "recoding" to --recording--.

Column 8

Line 34, change "runs out" to --runs out of--.

Column 9

Line 54, change "Grear train 16" to --gear train 16--.

Column 10

Line 19, change the first occurrence of "the" to --The--;
line 29, change "detail" to --detailed--; and
line 33, change "blow" to --below--.

UNITED STATES PATENT AND TRADEMARK OFFICE

CERTIFICATE OF CORRECTION

PATENT NO. : 6,070,958

DATED : June 6, 2000

INVENTOR(S) : Yuji Kanome

It is certified that error appears in the above-identified patent and that said Letters Patent is hereby corrected as shown below:

Column 11

Line 60, change "current" to --current of--.

Column 12

Line 65, change "recoding" to --recording--.

Column 15

Line 26, change "V(Tk)" to --V(TB)--; and
line 67, change "recoding" to --recording--.

Column 17

Line 19, change "if" to --of--;
line 25, change "ion" to --in--; and
line 39, change "is" to --are--.

Column 19

Line 34, change "a record signal applied" to --an applied record signal--.

UNITED STATES PATENT AND TRADEMARK OFFICE

CERTIFICATE OF CORRECTION

PATENT NO. : 6,070,958

DATED : June 6, 2000

INVENTOR(S) : Yuji Kanome

It is certified that error appears in the above-identified patent and that said Letters Patent is hereby corrected as shown below:

Column 20

Line 6, change "of" to --of the--;
line 24, change "recoding" to --recording--;
line 26, change "an" to --a--; and
line 32, change "recoding" to --recording--.

Column 23

Line 43, change "recoding" to --recording--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*